US008014689B2

(12) United States Patent
Nishizawa

(10) Patent No.: US 8,014,689 B2
(45) Date of Patent: Sep. 6, 2011

(54) IMAGE FORMING APPARATUS, METHOD OF GAMMA CORRECTION AND STORAGE MEDIUM STORING GAMMA CORRECTION PROGRAM

(75) Inventor: Akira Nishizawa, Osaka (JP)

(73) Assignee: Kyocera Mita Corporation (JP)

( * ) Notice: Subject to any disclaimer, the term of this patent is extended or adjusted under 35 U.S.C. 154(b) by 349 days.

(21) Appl. No.: 12/121,237

(22) Filed: May 15, 2008

(65) Prior Publication Data

US 2008/0285990 A1 Nov. 20, 2008

(30) Foreign Application Priority Data

May 18, 2007 (JP) ..... 2007-132963
May 18, 2007 (JP) ..... 2007-132964
May 18, 2007 (JP) ..... 2007-132965
May 18, 2007 (JP) ..... 2007-132966

(51) Int. Cl.
*G03G 15/00* (2006.01)

(52) U.S. Cl. ..... 399/49

(58) Field of Classification Search ..... 399/49, 399/77, 39; 358/519
See application file for complete search history.

(56) References Cited

U.S. PATENT DOCUMENTS 6,148,158 A * 11/2000 Amemiya ..... 399/39
2004/0223173 A1* 11/2004 Arai ..... 358/1.9
2005/0030562 A1* 2/2005 Hama et al. ..... 358/1.9

FOREIGN PATENT DOCUMENTS

JP 2005-62357 3/2005

* cited by examiner

*Primary Examiner* — David Gray
*Assistant Examiner* — Rodney Bonnette
(74) *Attorney, Agent, or Firm* — Gerald E. Hespos; Michael J. Porco

(57) ABSTRACT

An image forming apparatus is configured to control the density of an output image based on an inherent gamma characteristic of the apparatus. The apparatus includes a patch image forming unit that forms patch images having multiple gradation values, a measuring unit that measures the density or lightness of each patch image, a sample point arrangement unit that arranges sample points representative of measured density or lightness values in a descending or ascending order of the gradation values, an inflection point region detecting unit that detects any specific inflection point region, a straight line region detecting unit that detects any specific straight line region, an interpolating unit that interpolates by adding and/or deleting a specific sample point depending upon whether (i) an inflection point region is detected, (ii) a straight line region is detected, or (iii) neither an inflection point region nor a straight line region is detected.

11 Claims, 11 Drawing Sheets

IMAGE FORMING APPARATUS, METHOD OF GAMMA CORRECTION AND STORAGE MEDIUM STORING GAMMA CORRECTION PROGRAM

BACKGROUND OF THE INVENTION

1. Field of the Invention

The present invention relates generally to an image forming apparatus, such as a printer, a facsimile machine or a copying machine, which outputs printed images formed by using toner. More particularly, the invention is concerned with an image forming apparatus featuring a gamma characteristic correction function for optimizing toner density output values, for instance, according to input gradations (tone levels), as well as a storage medium storing a gamma correction program used for making gamma correction and a method of gamma correction.

2. Description of the Related Art

Conventionally, an image forming apparatus like a printer generates an image signal from input print data by performing image forming operation, adjusts toner densities according to the image signal and, then, produces and delivers a printout carrying an image printed with proper gradations. This kind of image forming apparatus is configured to carry out so-called gamma correction to correct a gamma characteristic of the apparatus so that toner densities on each printout match the image signal. Ideally, the gamma characteristic should be such that the toner density linearly increases with an increase in gradation. Practically, however, individual image forming apparatuses have varying gamma characteristics and, thus, each image forming apparatus is subjected to a gamma correction process and thereby initialized to provide a linear gamma characteristic at a final stage of manufacture.

Although each image forming apparatus is properly initialized to provide a linear gamma characteristic as mentioned above, the gamma characteristic of each apparatus deviates from an initial setting thereof, causing irregularities in the density of toner adhering to a photosensitive member, due to changes that occur with the lapse of time. For this reason, a conventional image forming apparatus is re-subjected to the gamma correction process at regular time intervals or when the amount of deviation of the gamma characteristic of the apparatus from the initially set linear gamma characteristic exceeds a threshold value, for example, so that toner densities on each printout become normal.

Generally, the gamma correction process carried out by the conventional image forming apparatus includes the steps of causing toner particles to adhere to the photosensitive member according to patch images used for gamma correction, measuring toner densities of the patch images by a sensor, and correcting the gamma characteristic of the apparatus based on measured values of the toner densities. The patch images taken from a test print as samples usually contain not a little noise components, so that it is necessary to repeatedly measure the toner densities of the patch images several times or increase the number of sampled patch images and, then, calculate mean values of measured data in order to reduce the influence of noise.

However, if the toner densities of the patch images are repeatedly measured or the number of sampled patch images is increased, the gamma correction process would require extra processing time for generating the patch images and measuring the toner densities thereof, resulting in a reduction in overall processing speed.

One approach conventionally used to cope with the aforementioned problem is to measure toner densities of patch images taken at a predetermined small number of sample points (e.g., 8 sample points) of gradation and interpolate measured values of the toner densities a multiple number of times to increase the number of samples in order to obtain samples of substantially continuous gradations to determine the entire gamma characteristic.

Specifically, if it is intended to determine the gamma characteristic from 8 sample points as shown in FIG. 14, the aforementioned gamma correction approach employs a method of interpolating operation performed on four consecutive sample points, for example. In the example of FIG. 14, formulae of straight lines L1, L2, L3 containing line segments $S_1S_2$, $S_2S_3$, $S_3S_4$ are determined and Y values (density values) N1, N2, N3 on the respective line segments $S_1S_2$, $S_2S_3$, $S_3S_4$ at a gradation value x1 on an x-axis are calculated.

Then, the aforementioned density values N1, N2, N3 are weighted and an interpolation point of the weighted density values N1, N2, N3 is obtained. In this process, the interpolation point is calculated each time by weighted averaging operation performed by using a predefined equation ($\alpha \cdot N1 + \beta \cdot N2 + \gamma \cdot N3$) based on a predetermined weight ratio $\{\alpha, \beta, \gamma\}$, or based on a ratio of distances between points of the individual density values N1, N2, N3, for example.

If the interpolating operation of the aforementioned interpolation method of the prior art is used to interpolate sample points $S_0$-$S_7$ which are located as shown in FIG. 13, for example, an interpolation point $X_1$ in a region $S_1$-$S_2$ is obtained by determining a point N1 on a straight line containing a line segment $S_0S_1$, a point N2 on a straight line containing a line segment $S_1S_2$ and a point N3 on a straight line containing a line segment $S_2S_3$ at the same x-coordinate as a midpoint of the line segment $S_1S_2$ and calculating a mean value of lightness values of the points N1, N2, N3. In this example, the point N3 is located significantly apart from the point N2 and, for this reason, the interpolation point $X_1$ deviates from a true gradation characteristic curve. A similar situation occurs with an interpolation point $X_6$ obtained for a region $S_6$-$S_7$ as well.

SUMMARY OF THE INVENTION

In light of the foregoing, it is an object of the present invention to provide an image forming apparatus which makes it possible to properly correct a gamma characteristic of the apparatus without producing the aforementioned problem of the prior art. It is a further object of the invention to provide a storage medium storing a gamma correction program used for properly making gamma correction as well as a method of performing accurate gamma correction.

An embodiment of the invention provides an image forming apparatus configured to control the density of an output image based on an inherent gamma characteristic of the image forming apparatus. This image forming apparatus of the embodiment of the invention includes a patch image forming unit that forms a plurality of patch images having multiple gradation values on a specific medium, a measuring unit that measures the density or lightness of each of the patch images formed on the medium, a sample point arrangement unit that arranges sample points representative of measured density or lightness values in a descending or ascending order of the gradation values, an inflection point region detecting unit that detects any specific inflection point region from among regions defined between the consecutively arranged sample points, a straight line region detecting unit that detects any specific straight line region from among the regions defined between the consecutively arranged sample points, an interpolating operation unit that performs interpolating operation by adding and/or deleting a specific sample point depending on whether (i) an inflection point region is detected, (ii) a straight line region is detected, or (iii) neither an inflection point region nor a straight line region is detected, a characteristic acquisition unit that acquires a gradation characteristic by the interpolating operation, and a characteristic correction unit that corrects the gamma characteristic based on the acquired gradation characteristic.

Another embodiment of the invention also provides a storage medium storing a gamma correction program used for output density control of an image forming apparatus which outputs image data based on an inherent gamma characteristic of the image forming apparatus. The gamma correction program stored in the storage medium of the embodiment of the invention causes a computer which constitutes the image forming apparatus to function as a patch image forming unit that forms a plurality of patch images having multiple gradation values on a specific medium, a measuring unit that measures the density or lightness of each of the patch images formed on the medium, a sample point arrangement unit that arranges sample points representative of measured density or lightness values in a descending or ascending order of the gradation values, an inflection point region detecting unit that arranges any specific inflection point region from among regions defined between the consecutively arranged sample points, a straight line region detecting unit that detects any specific straight line region from among the regions defined between the consecutively arranged sample points, an interpolating operation unit that performs interpolating operation by adding and/or deleting a specific sample point depending on whether (i) an inflection point region is detected, (ii) a straight line region is detected, or (iii) neither an inflection point region nor a straight line region is detected, a characteristic acquisition unit that acquires a gradation characteristic by the interpolating operation, and a characteristic correction unit that corrects the gamma characteristic based on the acquired gradation characteristic.

Yet another embodiment of the invention also provides a method of performing gamma correction for output density control of an image forming apparatus which outputs image data based on an inherent gamma characteristic of the image forming apparatus. This gamma correction method of the embodiment of the invention includes the steps of forming a plurality of patch images having multiple gradation values on a specific medium, measuring the density or lightness of each of the patch images formed on the medium, arranging sample points representative of measured density or lightness values in a descending or ascending order of the gradation values, detecting any specific inflection point region from among regions defined between the consecutively arranged sample points, detecting any specific straight line region from among the regions defined between the consecutively arranged sample points, performing interpolating operation by adding and/or deleting a specific sample point depending on whether (i) an inflection point region is detected, (ii) a straight line region is detected, or (iii) neither an inflection point region nor a straight line region is detected, acquiring a gradation characteristic by the interpolating operation, and correcting the gamma characteristic based on the acquired gradation characteristic.

These and other objects, features and advantages of the present invention will become apparent from the following detailed description if read along with the accompanying drawings.

DETAILED DESCRIPTION OF THE PREFERRED EMBODIMENT

An image forming apparatus 10 and a gamma correction program according to a preferred embodiment of the present invention are now described with reference to the accompanying drawings. In the following discussion of the invention, a "gradation characteristic" refers to an actual characteristic of the image forming apparatus 10 including interpolation values and a "gamma characteristic" refers to a precorrected characteristic or a characteristic corrected based on the gradation characteristic.

The image forming apparatus 10 of the invention described hereinbelow is configured to work through various processing steps, units and functions carried out, or realized, by a computer with the aid of instructions of a software program. The program gives instructions to individual constituent elements of the computer to cause these elements to carry out specific processing steps and functions which will be described herein. In other words, the individual processing steps, units and functions of the image forming apparatus 10 of the present embodiment are realized by coordinated working of the program and the computer.

All or part of the program is provided on a storage medium which is readable by an appropriate computer. The storage medium may be a magnetic disk, an optical disc or a semiconductor memory, for example. The program read from the storage medium is installed on the computer and run thereby. Alternatively, the program may be directly downloaded through a communications network into the computer and run thereby.

Figure 1:
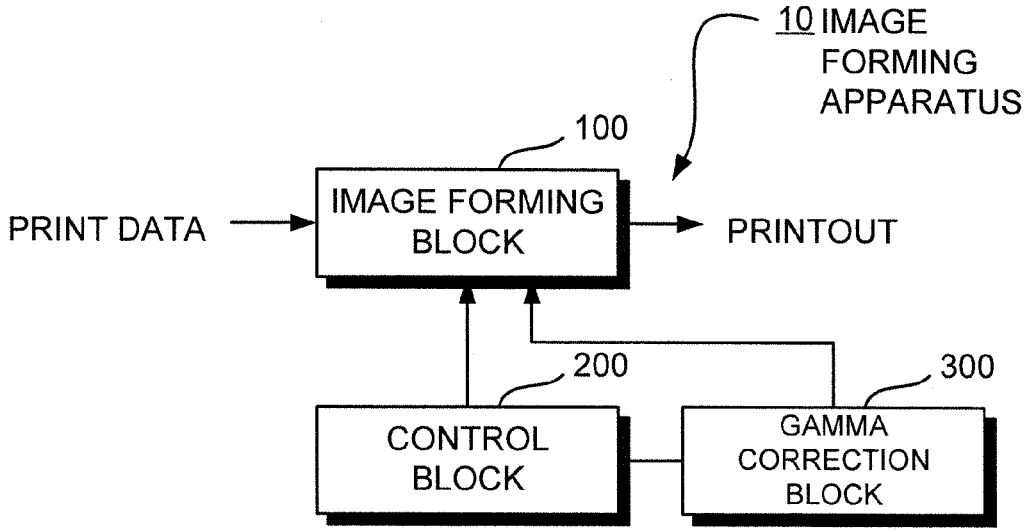
FIG. 1 is a block diagram of an image forming apparatus according to a preferred embodiment of the present invention.

The image forming apparatus 10 of the embodiment is described in detail with reference to FIGS. 1 to 12. FIG. 1 is a block diagram of the image forming apparatus 10 according to the preferred embodiment of the invention.

The image forming apparatus 10 of the present embodiment is a printer, for example, including an image forming block 100, a control block 200 and a gamma correction block 300 as shown in FIG. 1.

The image forming block 100 is configured to generate image data according to print data input from an external host computer and, then, produces and delivers a printout carrying an image printed based on the image data. The image forming block 100 also serves as a patch image forming unit mentioned in the appended claims for forming patch images according to patch image data input from the gamma correction block 300 for gamma correction.

The control block 200 controls the image forming block 100 to cause the same to perform a print job according to the input print data. Specifically, the control block 200 controls the image forming block 100 to adjust toner densities of a printed image having multi-level gradations (e.g., 256 tone levels) according to a gamma characteristic initially set or corrected by the gamma correction block 300 so that the image forming block 100 would perform the print job in a proper fashion.

The image forming apparatus 10 of the embodiment is configured such that the working of the control block 200 and the gamma correction block 300 is controlled by the program run on the computer.

Figure 2:
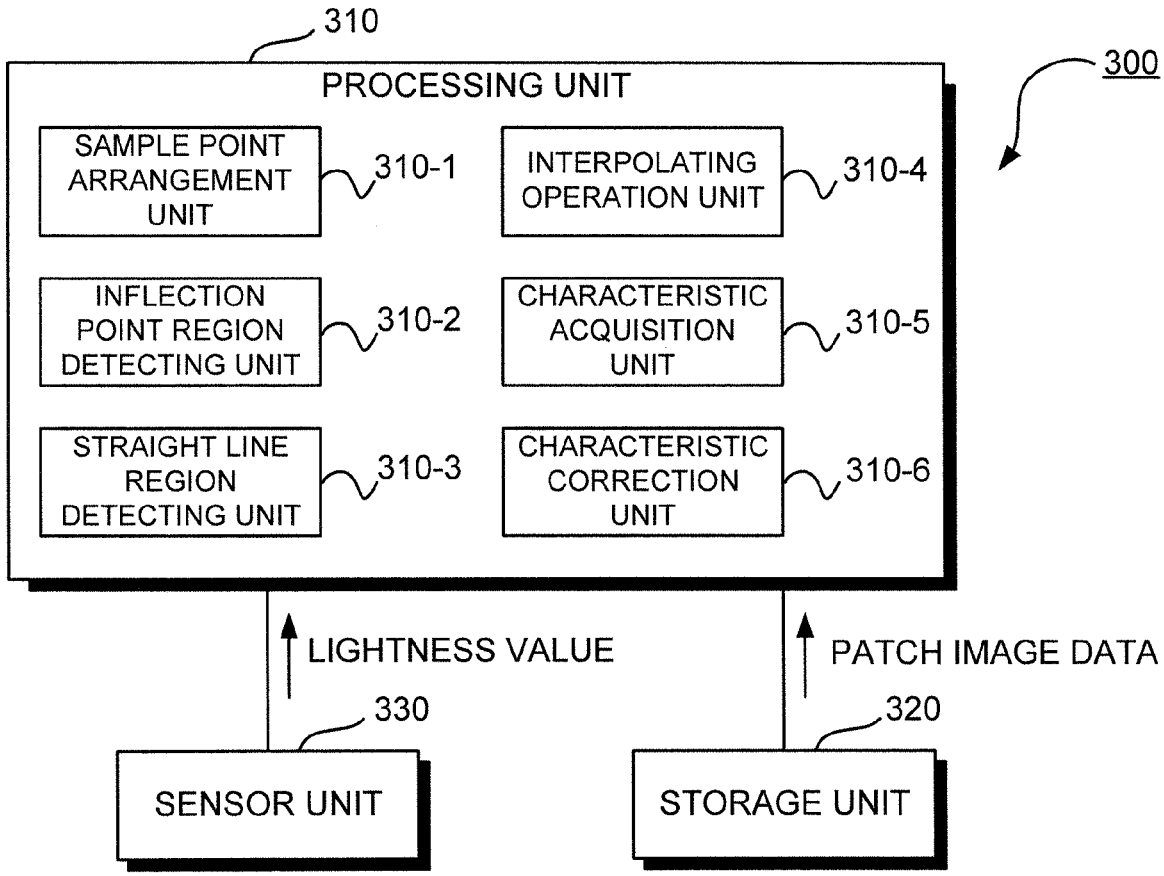
FIG. 2 is a block diagram showing an example of the configuration of a gamma correction block of the image forming apparatus according to the preferred embodiment of the invention.

The gamma correction block 300 performs gamma correction at a stage of initial setting, at regular time intervals or when the amount of deviation of the gamma characteristic from the initially set linear gamma characteristic exceeds a threshold value. The gamma correction block 300 includes a processing unit 310, a storage unit 320 and a sensor unit 330 as shown in FIG. 2.

The storage unit 320 registers the patch image data used for gamma correction and serves also as a working memory.

The sensor unit 330, which constitutes a measuring unit mentioned in the appended claims, detects lightness of each patch image formed on a photosensitive drum (photosensitive member) of the image forming block 100 in a process of patch image printing by the image forming block 100 according to the patch image data input for gamma correction.

When performing a gamma correction process, the processing unit 310 reads out the patch image data for gamma correction from the storage unit 320 and outputs the patch image data to the image forming block 100. Then, the processing unit 310 causes the image forming block 100 to form patch images used for gamma correction.

As will be described in detail hereinbelow, the processing unit 310 carries out sample point arrangement operation, inflection point region detecting operation, straight line region detecting operation, interpolating operation and gradation characteristic acquisition operation and outputs a corrected gamma characteristic to the control block 200. To execute these operations, the processing unit 310 is configured to serve as a sample point arrangement unit 310-1, an inflection point region detecting unit 310-2, a straight line region detecting unit 310-3, an interpolating operation unit 310-4, a characteristic acquisition unit 310-5 and a characteristic correction unit 310-6.

Figure 3:
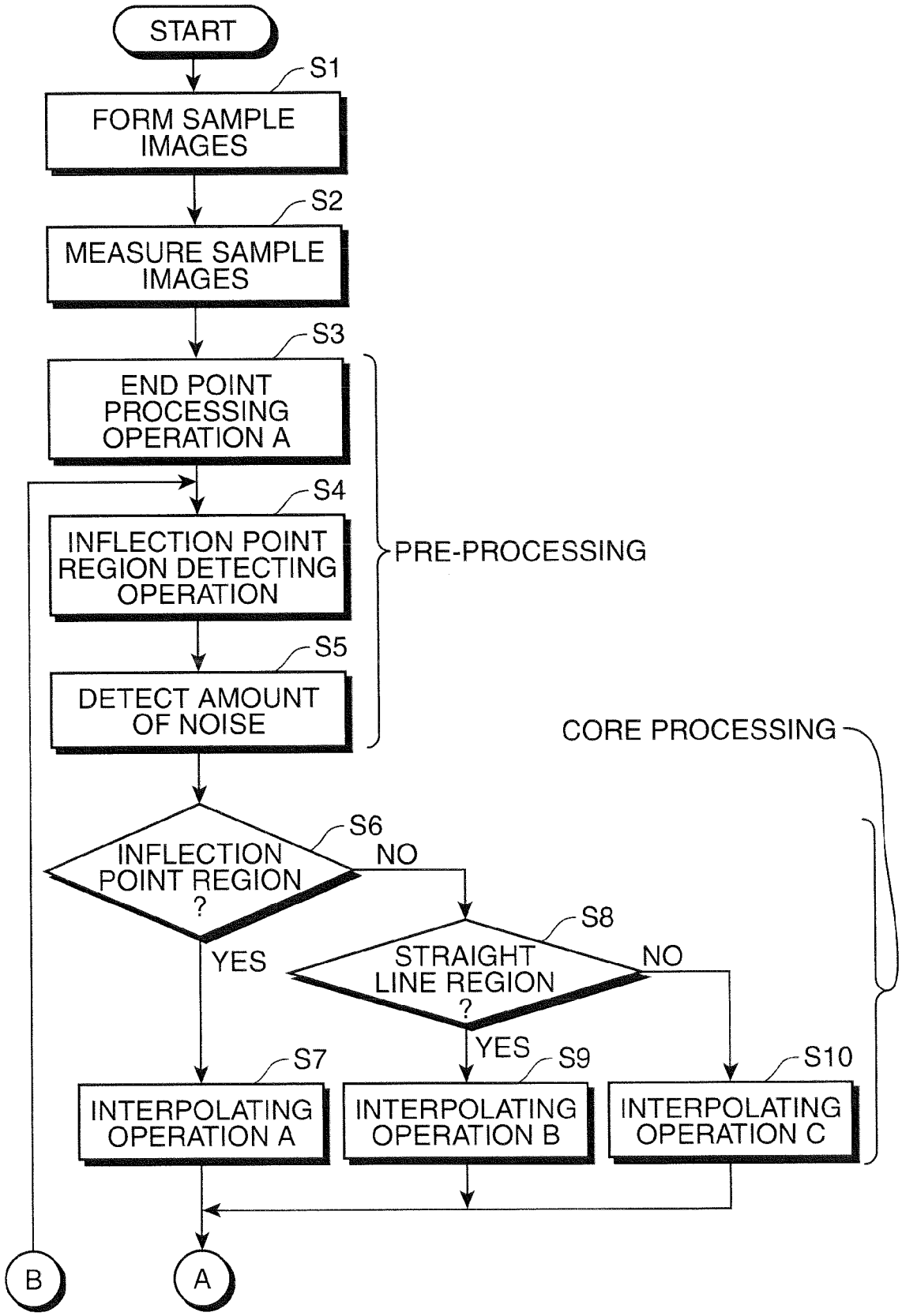
FIG. 3 is a first half of a flowchart showing a gamma correction process performed by the image forming apparatus of the embodiment.
Figure 4:
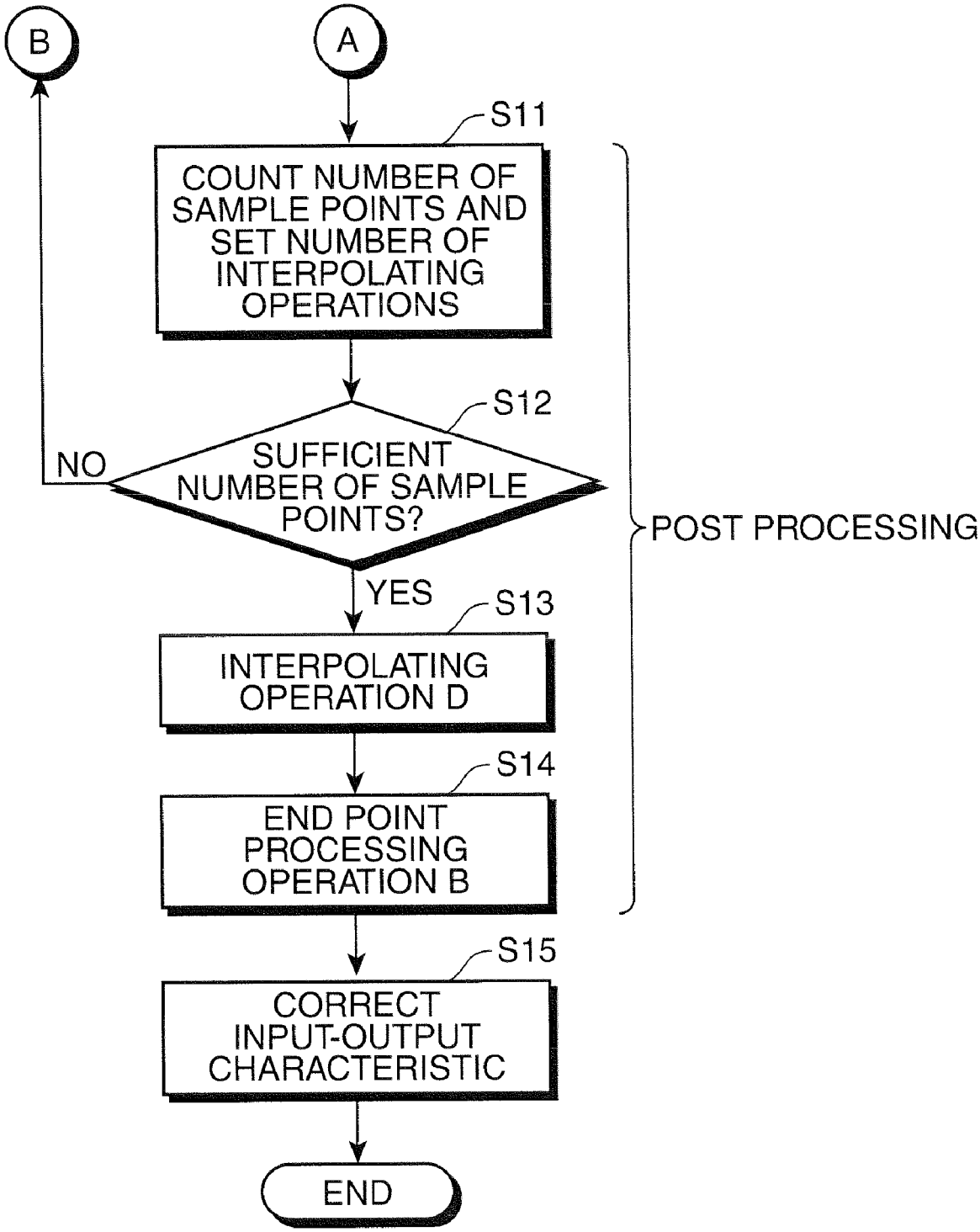
FIG. 4 is a second half of the flowchart showing the gamma correction process of the embodiment.

Now, a procedure of the gamma correction process performed by the image forming apparatus 10 of the present embodiment is described in detail. FIG. 3 is a first half of a flowchart showing the gamma correction process performed by the image forming apparatus 10 of the embodiment, and FIG. 4 is a second half of the flowchart showing the gamma correction process of the embodiment.

Referring to FIG. 3, the image forming block 100 of the image forming apparatus 10 first forms a specific pattern of patch images used as sample images (step S1) and the sensor unit 330 measures lightness levels of the patch images (step S2).

Specifically, the image forming block 100 forms a plurality of patch images (sample points) having multiple tone levels (color values) on the photosensitive member or on a sheet of paper and the sensor unit 330 measures lightness levels at the individual sample points. If an entire gradation range includes 256 tone levels, for example, it is desirable to arrange a relatively small number of sample points (e.g., 8, 17 or 33 sample points) arranged apart from one another from a viewpoint of processing efficiency.

The processing unit 310 serving as the sample point arrangement unit can obtain an outline of an actual gamma characteristic of the image forming apparatus 10 by arranging measured values (tone levels) of the sample points in a descending or ascending order of gradation values on a Cartesian coordinate system of which x-axis represents the tone level and y-axis represents the lightness level, for example.

Subsequently, the processing unit 310 of the gamma correction block 300 carries out pre-processing of steps S3 to S5 in preparation of core processing, that is, the interpolating operation. The pre-processing begins with execution of end point processing operation A (step S3). The end point processing operation A makes it possible to perform interpolating operation similar to interpolating operations (i.e., later-described interpolating operation A, interpolating operation B and interpolating operation C) performed on sample point regions other than regions in the vicinity of each end point (end sample point) without the need to perform a special interpolating operation in the regions in the vicinity of each end point.

Figure 5:
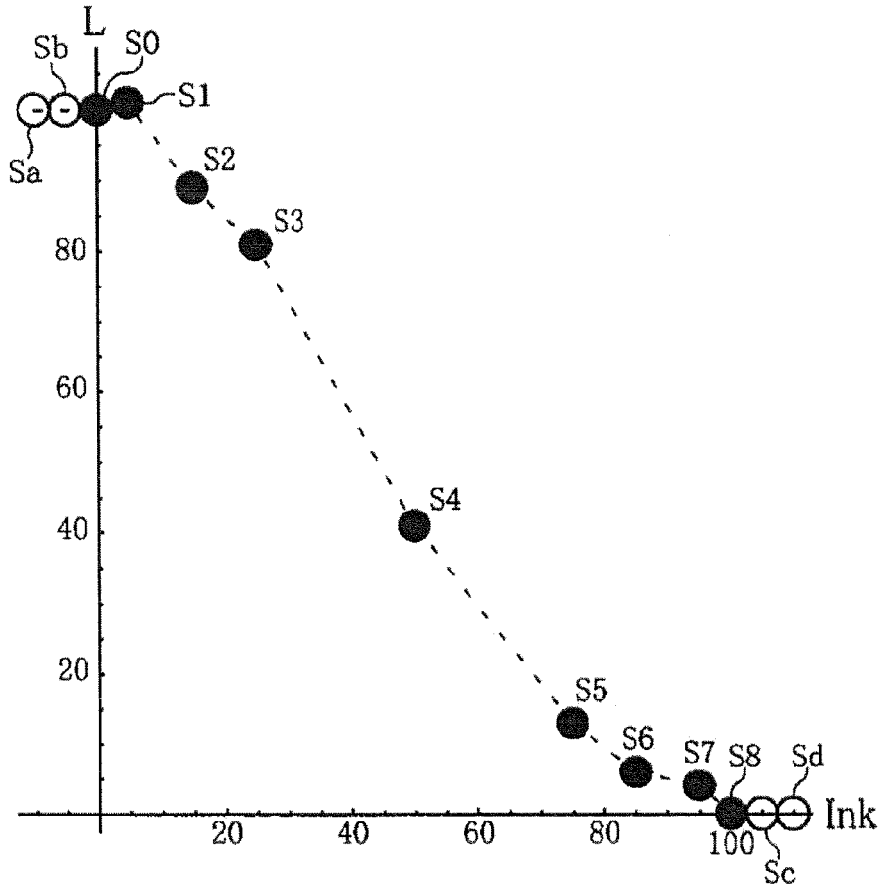
FIG. 5 is an explanatory diagram showing an outline of end point processing operation performed in a pre-processing step by the image forming apparatus of the embodiment.

The present embodiment requires four consecutive sample points for execution of the interpolating operation. This is because the processing unit 310 can not perform the interpolating operation at minimum and maximum gradation sides with the original sample points alone. Specifically, the processing unit 310 generates dummy, or imaginary, sample points (Sa, Sb, Sc, Sd) as shown in FIG. 5.

Figure 6:
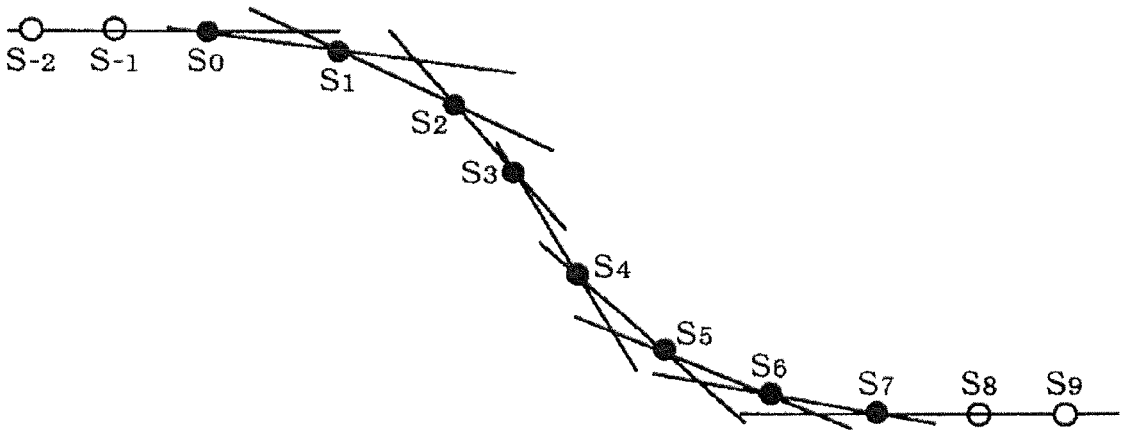
FIG. 6 is an explanatory diagram showing details of the end point processing operation performed in a pre-processing step by the image forming apparatus of the embodiment.

More specifically, provided that there are initially sample points $S_0$-$S_7$ as shown in FIG. 6, the processing unit 310 adds imaginary sample points $S_{-2}$, $S_{-1}$, $S_8$, $S_9$ as auxiliary data on the outside of regions defined by the original sample points. This makes it possible to perform the interpolating operation in the regions in the vicinity of each end point, that is, in sample point regions ($S_{-2}$-$S_1$, $S_{-1}$-$S_2$, $S_5$-$S_8$, $S_6$-$S_9$) by using the same algorithm as used for the interpolating operation performed on the non-end-point sample point regions.

Preferably, the added imaginary sample points have the same lightness value (y-axis) as each end sample point and are arranged to fall in 5% to 10% of an input range of the sample images with respect to gradation values (x-axis).

Then, as a next pre-processing step, the processing unit 310 detects each inflection point region as shown in FIG. 3 (step S4).

The earlier-described conventional interpolation method, if applied to an inflection point region, gives rise to an overshooting problem. Also, an inflection point region can not be corrected by a later-described interpolation method (i.e., interpolating operation C) of the embodiment used for a simply changing region.

Under such circumstances, the processing unit 310 serving as the inflection point region detecting unit detects inflection point regions from all of the sample points in advance by sensing changes in turning direction of angles formed by consecutive pairs of two adjacent regions or by using second derivatives. When a specific inflection point region is detected, the processing unit 310 performs the later-described interpolating operation A of the embodiment (refer to step S7 of FIG. 3).

A method of detecting an inflection point region performed by the processing unit 310 serving as the inflection point region detecting unit is described in detail below.

First, the method of detecting an inflection point region by sensing changes in turning direction of angles formed by consecutive pairs of two adjacent regions is described.

Specifically, the processing unit 310 examines whether the angle formed by consecutive pairs of two adjacent regions turns in the same direction over four consecutive sample points (three consecutive regions). If the angle formed by consecutive pairs of two adjacent regions successively turns in the same direction, the processing unit 310 judges that there is no inflection point in the regions defined by the four consecutive sample points. If the angle formed by consecutive pairs of two adjacent regions successively turns in different directions, on the other hand, the processing unit 310 judges that there exists an inflection point in the regions defined by the four consecutive sample points.

Figure 7:
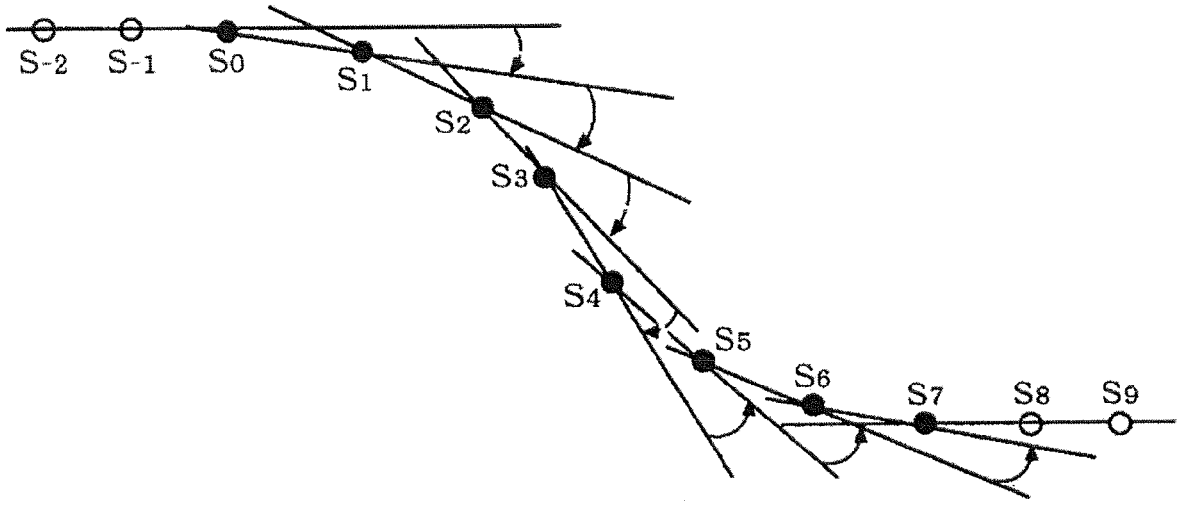
FIG. 7 is an explanatory diagram showing inflection point region detecting operation performed in a pre-processing step by the image forming apparatus of the embodiment.

For example, in regions $S_2$-$S_5$ shown in FIG. 7, a line segment $S_3S_4$ turns in a clockwise direction (positive direction) from a line segment $S_2S_3$ and a line segment $S_4S_5$ turns in a counterclockwise direction (negative direction) from the line segment $S_3S_4$. Thus, it is possible to judges that there exists an inflection point in a region $S_3$-$S_4$.

Next, the method of detecting an inflection point region by using second derivatives, that is, by examining changes in sign (plus or minus) over consecutive regions is described.

Specifically, the processing unit 310 calculates a difference between the gradients of two regions defined by first three of four consecutive sample points and a difference between the gradients of two regions defined by last three of the four consecutive sample points and determines whether each of the gradient differences has a plus or minus sign. Then, if the gradient differences have the same sign (plus or minus), the processing unit 310 judges that there is no inflection point in the regions defined by the four consecutive sample points. If the gradient differences have different signs (plus and minus), on the other hand, the processing unit 310 judges that there exists an inflection point in the regions defined by the four consecutive sample points.

Next, as a last pre-processing step, the processing unit 310 detects the amounts of noise contained in the measured lightness levels of the patch images (step S5). If the sample values measured in step S2 contains large amounts of noise, it is impossible to accurately determine the gradation characteristic of the image forming apparatus 10 and subsequent steps of the gamma correction process will be adversely affected. For example, if the detected amount of noise exceeds a predefined threshold value, the processing unit 310 terminates the current gamma correction process, for instance.

Subsequently, the processing unit 310 serving as the interpolating operation unit performs the aforementioned interpolating operation (steps S6 to S10).

Firstly, the processing unit 310 serving as the inflection point region detecting unit judges whether any of regions to be examined contains a specific inflection point (step S6). The interpolating operation A of step S7, the interpolating operation B of step S9 and the interpolating operation C of step S10 shown in FIG. 3 are described hereunder with reference to four specific Examples (Examples 1 to 4).

Specifically, if there exists an inflection point region according to a result of the judgment made by using the result of inflection point region detection in step S4 (Yes in step S6), the processing unit 310 serving as the interpolating operation unit performs the interpolating operation A (step S7).

EXAMPLE 1

The interpolating operation A performed in Example 1 is described with reference to FIGS. 8A-8C.

Figure 8A:
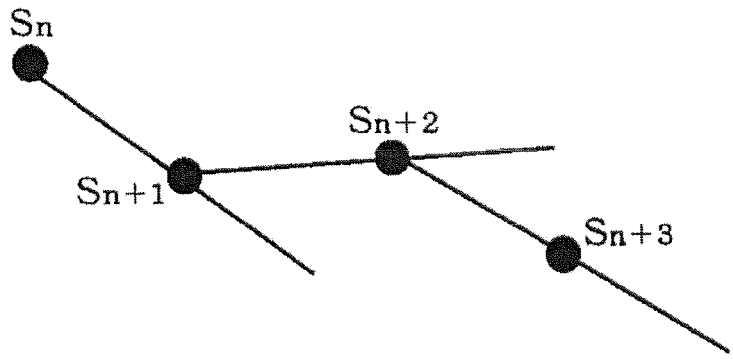
FIGS. 8A-8C are explanatory diagrams showing interpolating operation performed on an inflection point region in a core processing step by the image forming apparatus of the embodiment.
Figure 8B:
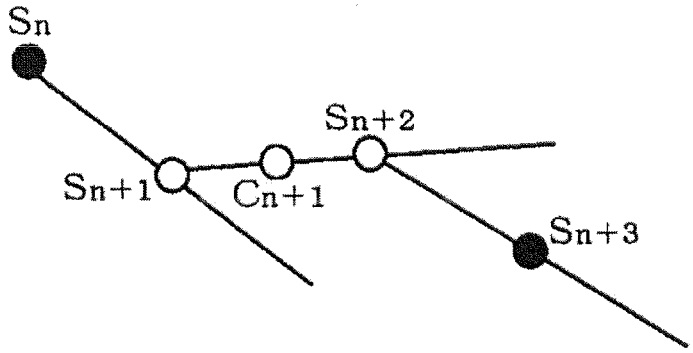

FIG. 8A shows a typical example in which a line segment $S_{n+1}S_{n+2}$ has an inflection point and FIG. 8B shows a gradation characteristic obtained as a result of the interpolating operation.

If an inflection point is found on an intermediate line segment (line segment $S_{n+1}S_{n+2}$) of four consecutive sample points ($S_n$, $S_{n+1}$, $S_{n+2}$, $S_{n+3}$) as shown in FIG. 8A, the processing unit 310 adds a midpoint $C_{n+1}$ of the intermediate line segment (line segment $S_{n+1}S_{n+2}$) as an interpolation point (interpolated sample point) as shown in FIG. 8B and deletes the sample points $S_{n+1}$ and $S_{n+2}$ by performing the interpolating operation A.

Figure 9:
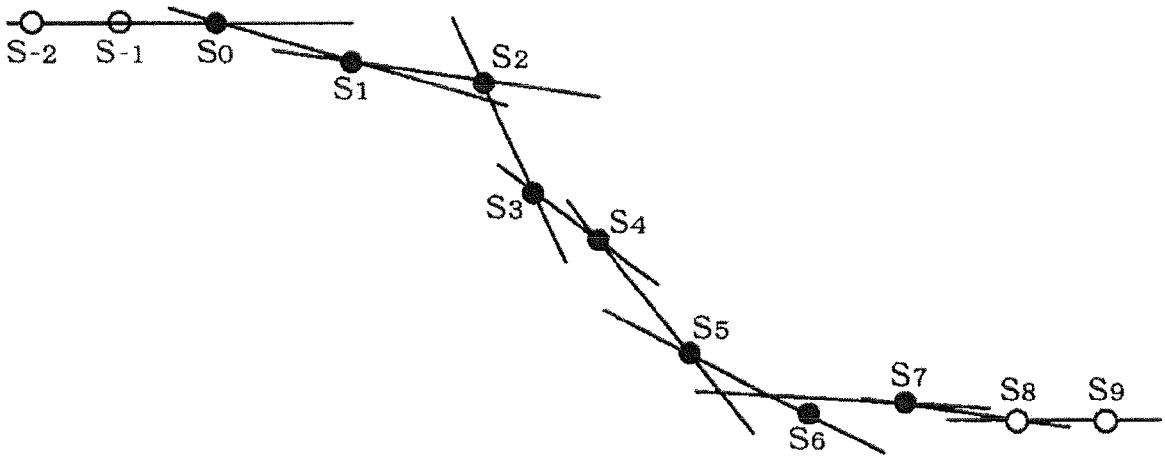
FIG. 9 is an example of a gradation characteristic curve containing a large number of inflection point regions.

The interpolating operation A is particularly effective in an example shown in FIG. 9 containing a large number of inflection point regions. In the example of FIG. 9, only a line segment $S_5S_6$ is a simply changing region and all other line segments have inflection points.

If it is judged that none of the examined regions contains a specific inflection point (No in step S6), the processing unit 310 serving as the straight line region detecting unit judges whether any of the regions to be examined contains a specific straight line region (step S8).

Figure 10A:
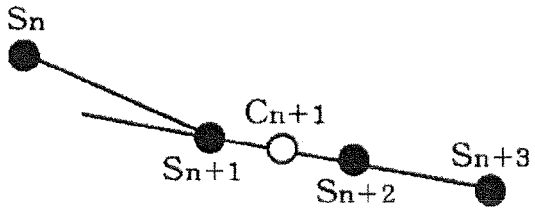
FIGS. 10A-10D are explanatory diagrams showing interpolating operation performed on a straight line region in a core processing step by the image forming apparatus of the embodiment.
Figure 10B:
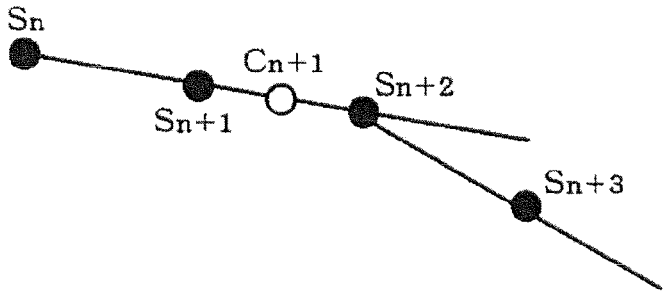

Specifically, if last three or first three of four consecutive sample points are arranged on a straight line as shown in FIGS. 10A and 10B, respectively, the processing unit 310 serving as the straight line region detecting unit judges that a central line segment of three line segments formed by the four consecutive sample points is a specific straight line region.

If it is judged that a specific straight line region exists in the examined regions (Yes in step S8), the processing unit 310 serving as the interpolating operation unit performs the interpolating operation B (step S9) which is described in detail below.

If last three sample points ($S_{n+1}$, $S_{n+2}$, $S_{n+3}$) or first three sample points ($S_n$, $S_{n+1}$, $S_{n+2}$) of four consecutive sample points ($S_n$, $S_{n+1}$, $S_{n+2}$, $S_{n+3}$) are arranged on a straight line as shown in FIGS. 10A and 10B, respectively, the processing unit 310 adds a midpoint $C_{n+1}$ of the intermediate line segment (line segment $S_{n+1}S_{n+2}$) as an interpolation point (interpolated sample point) by performing the interpolating operation B. This makes it possible to properly perform the interpolating operation on each region which is not a simply changing region or an inflection point region.

If it is judged that none of the examined regions is a specific straight line region (No in step S8), on the other hand, the processing unit 310 serving as the interpolating operation unit performs the interpolating operation C (step S10). The interpolating operation C is an interpolation process performed on a simply changing region which is not a specific inflection point region or straight line region.

Figure 11A:
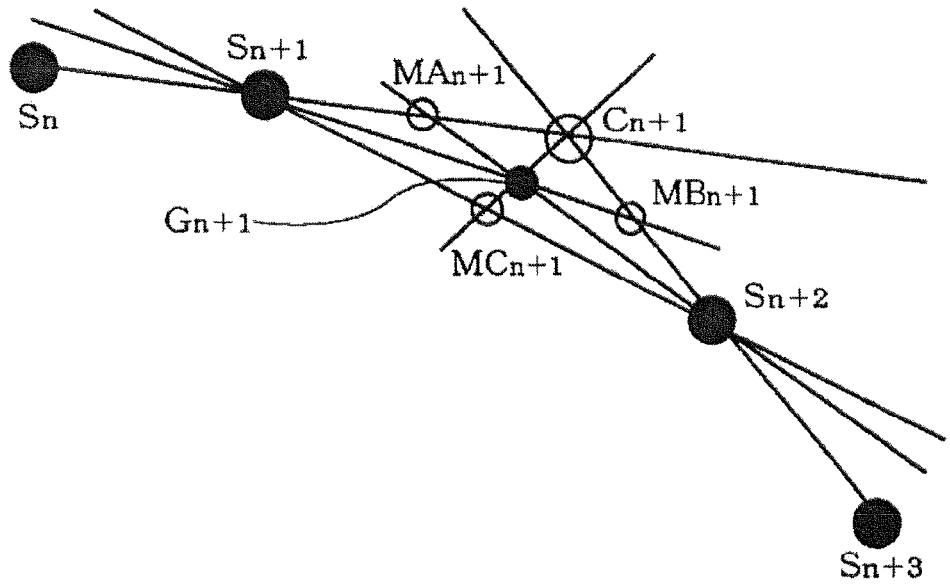
FIGS. 11A-11B are explanatory diagrams showing interpolating operation performed on a simply changing region in a core processing step by the image forming apparatus of the embodiment.

Specifically, with four consecutive sample points ($S_n$, $S_{n+1}$, $S_{n+2}$, $S_{n+3}$) given as shown in FIG. 11A, the processing unit 310 determines an intersection point $C_{n+1}$ of a line extended from a first region line segment $S_nS_{n+1}$ in a direction of $S_{n+1}$ and a line extended from a last region line segment $S_{n+2}S_{n+3}$ in a direction of $S_{n+2}$ and, then, adds a center of gravity $G_{n+1}$ of a triangle $S_{n+1}S_{n+2}C_{n+1}$ as an interpolation point (interpolated sample point) by performing the interpolating operation C.

EXAMPLE 2

The interpolating operation A performed in Example 2 is described with reference to FIGS. 8A-8C.

The interpolating operation A applied to Example 2 is essentially the same as applied to Example 1 in that if an inflection point is found on an intermediate line segment (line segment $S_{n+1}S_{n+2}$) of four consecutive sample points ($S_n$, $S_{n+1}$, $S_{n+2}$, $S_{n+3}$) as shown in FIG. 8A, the processing unit 310 adds a midpoint $C_{n+1}$ of the intermediate line segment (line segment $S_{n+1}S_{n+2}$) as an interpolation point (interpolated sample point) as shown in FIG. 8B and deletes the sample points $S_{n+1}$ and $S_{n+2}$.

The interpolating operation A is particularly effective in the example shown in FIG. 9 containing a large number of inflection point regions. In the example of FIG. 9, only the line segment $S_5S_6$ is a simply changing region and all other line segments have inflection points.

If it is judged that none of the examined regions contains a specific inflection point (No in step S6), the processing unit 310 serving as the straight line region detecting unit judges whether any of the regions to be examined contains a specific straight line region (step S8).

Specifically, if last three or first three of four consecutive sample points are arranged on a straight line as shown in FIGS. 10A and 10B, respectively, the processing unit 310 serving as the straight line region detecting unit judges that a central line segment of three line segments formed by the four consecutive sample points is a specific straight line region.

If it is judged that a specific straight line region exists in the examined regions (Yes in step S8), the processing unit 310 serving as the interpolating operation unit performs the interpolating operation B (step S9) which is described in detail below.

The interpolating operation B applied to Example 2 is essentially the same as applied to Example 1 in that if last three sample points ($S_{n+1}$, $S_{n+2}$, $S_{n+3}$) or first three sample points ($S_n$, $S_{n+1}$, $S_{n+2}$) of four consecutive sample points ($S_n$, $S_{n+1}$, $S_{n+2}$, $S_{n+3}$) are arranged on a straight line as shown in FIGS. 10A and 10B, respectively, the processing unit 310 adds a midpoint $C_{n+1}$ of the intermediate line segment (line segment $S_{n+1}S_{n+2}$) as an interpolation point (interpolated sample point). This makes it possible to properly perform the interpolating operation on each region which is not a simply changing region or an inflection point region.

If it is judged that none of the examined regions is a specific straight line region (No in step S8), on the other hand, the processing unit 310 serving as the interpolating operation unit performs the interpolating operation C (step S10). As discussed with reference to Example 1, the interpolating operation C applied to Example 2 is an interpolation process performed on a simply changing region which is not a specific inflection point region or straight line region.

Figure 11B:
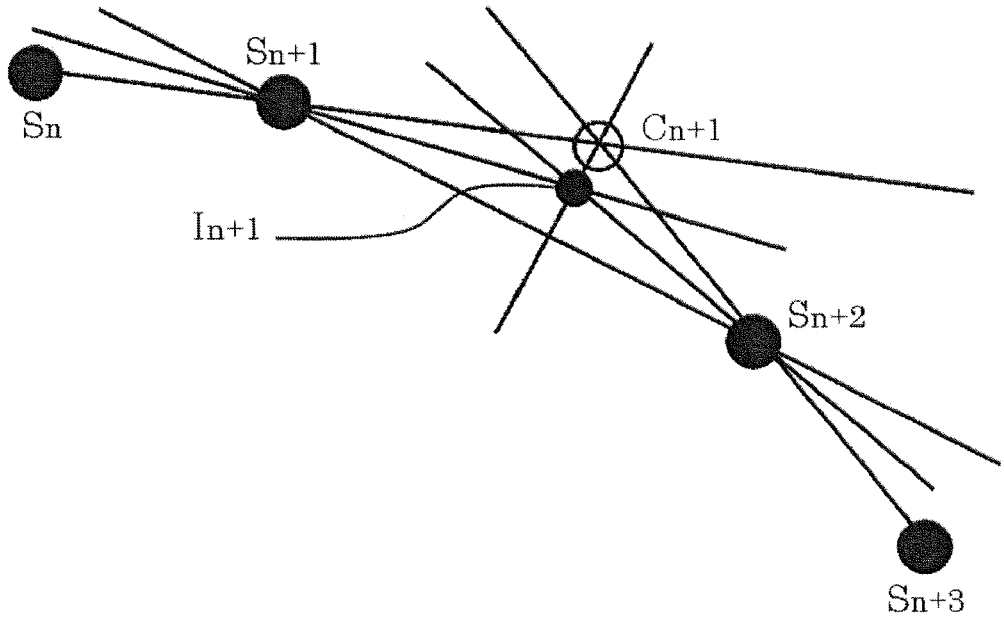

Specifically, with four consecutive sample points ($S_n$, $S_{n+1}$, $S_{n+2}$, $S_{n+3}$) given as shown in FIG. 11B, the processing unit 310 determines an intersection point $C_{n+1}$ of a line extended from a first region line segment $S_nS_{n+1}$ in a direction of $S_{n+1}$ and a line extended from a last region line segment $S_{n+2}S_{n+3}$ in a direction of $S_{n+2}$ and, then, adds an incenter $I_{n+1}$ of a triangle $S_{n+1}S_{n+2}C_{n+1}$ as an interpolation point (interpolated sample point) by performing the interpolating operation C. The incenter $I_{n+1}$ is a point where bisectors of three interior angles of the triangle $S_{n+1}S_{n+2}C_{n+1}$ intersect. Specifically, the incenter $I_{n+1}$ is given by the intersection point of the bisector of the interior angle formed by a line segment $S_{n+1}C_{n+1}$ and a line segment $S_{n+1}S_{n+2}$, the bisector of the interior angle formed by a line segment $C_{n+1}S_{n+2}$ and the line segment $S_{n+1}S_{n+2}$ and the bisector of the interior angle formed by the line segment $S_{n+1}C_{n+1}$ and the line segment $C_{n+1}S_{n+2}$.

EXAMPLE 3

The interpolating operation A performed in Example 3 is described with reference to FIGS. 8A-8C.

Figure 8C:
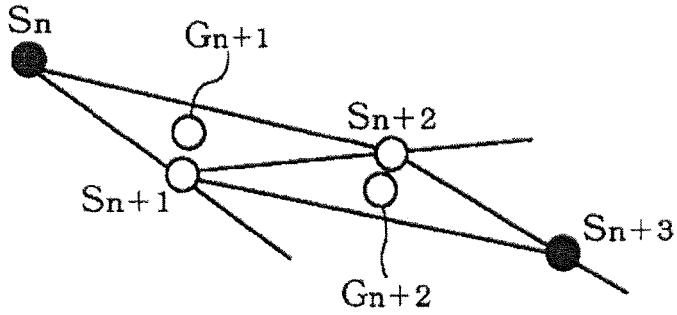

FIG. 8A shows a typical example in which the line segment $S_{n+1}S_{n+2}$ has an inflection point and FIG. 8C shows a gradation characteristic obtained as a result of the interpolating operation.

In the interpolating operation A applied to Example 3, if an inflection point is found on an intermediate line segment (line segment $S_{n+1}S_{n+2}$) of four consecutive sample points ($S_n$, $S_{n+1}$, $S_{n+2}$, $S_{n+3}$) as shown in FIG. 8A, the processing unit 310 adds a center of gravity $G_{n+1}$ of a triangle formed by three sample points $S_n$, $S_{n+1}$, $S_{n+2}$ and a center of gravity $G_{n+2}$ of a triangle formed by three sample points $S_{n+1}$, $S_{n+2}$, $S_{n+3}$ as interpolation points (interpolated sample points) as shown in FIG. 8C and deletes the sample points $S_{n+1}$ and $S_{n+2}$.

The interpolating operation A is particularly effective in the example shown in FIG. 9 containing a large number of inflection point regions. In the example of FIG. 9, only the line segment $S_5S_6$ is a simply changing region and all other line segments have inflection points.

If it is judged that none of the examined regions contains a specific inflection point (No in step S6), the processing unit 310 serving as the straight line region detecting unit judges whether any of the regions to be examined contains a specific straight line region (step S8).

Specifically, if last three or first three of four consecutive sample points are arranged on a straight line as shown in FIGS. 10A and 10B, respectively, the processing unit 310 serving as the straight line region detecting unit judges that a central line segment of three line segments formed by the four consecutive sample points is a specific straight line region.

If it is judged that a specific straight line region exists in the examined regions (Yes in step S8), the processing unit 310 serving as the interpolating operation unit performs the interpolating operation B (step S9) which is described in detail below.

The interpolating operation B applied to Example 3 is essentially the same as applied to Examples 1 and 2 in that if last three sample points ($S_{n+1}$, $S_{n+2}$, $S_{n+3}$) or first three sample points ($S_n$, $S_{n+1}$, $S_{n+2}$) of four consecutive sample points ($S_n$, $S_{n+1}$ $S_{n+2}$, $S_{n+3}$) are arranged on a straight line as shown in FIGS. 10A and 10B, respectively, the processing unit 310 adds a midpoint $C_{n+1}$ of the intermediate line segment (line segment $S_{n+1}S_{n+2}$) as an interpolation point (interpolated sample point). This makes it possible to properly perform the interpolating operation on each region which is not a simply changing region or an inflection point region.

If it is judged that none of the examined regions is a specific straight line region (No in step S8), on the other hand, the processing unit 310 serving as the interpolating operation unit performs the interpolating operation C (step S10). As discussed with reference to the foregoing Examples, the interpolating operation C applied to Example 3 is an interpolation process performed on a simply changing region which is not a specific inflection point region or straight line region.

Specifically, as discussed with reference to Example 1, with four consecutive sample points ($S_n$, $S_{n+1}$, $S_{n+2}$, $S_{n+3}$) given as shown in FIG. 11A, the processing unit 310 determines an intersection point $C_{n+1}$ of a line extended from a first region line segment $S_nS_{n+1}$ in a direction of $S_{n+1}$ and a line extended from a last region line segment $S_{n+2}S_{n+3}$ in a direction of $S_{n+2}$ and, then, adds a center of gravity $G_{n+1}$ of a triangle $S_{n+1}S_{n+2}C_{n+1}$ as an interpolation point (interpolated sample point) by performing the interpolating operation C. The center of gravity $G_{n+1}$ is a point where three medians of the triangle $S_{n+1}S_{n+2}C_{n+1}$ intersect. Specifically, the center of gravity $G_{n+1}$ is given by the intersection point of a straight line that joins a midpoint $MA_{n+1}$ of a line segment $S_{n+1}C_{n+1}$ to the sample point $S_{n+2}$, a straight line that joins a midpoint $MB_{n+1}$ of a line segment $S_{n+2}C_{n+1}$ to the sample point $S_{n+1}$ and a straight line that joins a midpoint $MC_{n+1}$ of a line segment $S_{n+1}S_{n+2}$ to the aforementioned intersection point $C_{n+1}$.

EXAMPLE 4

The interpolating operation A performed in Example 4 is described with reference to FIGS. 8A-8C.

FIG. 8A shows a typical example in which the line segment $S_{n+1}S_{n+2}$ has an inflection point and FIG. 8C shows a gradation characteristic obtained as a result of the interpolating operation.

The interpolating operation A applied to Example 4 is essentially the same as applied to Example 3 in that if an inflection point is found on an intermediate line segment (line segment $S_{n+1}S_{n+2}$) of four consecutive sample points ($S_n$, $S_{n+1}$, $S_{n+2}$, $S_{n+3}$) as shown in FIG. 8A, the processing unit 310 adds a center of gravity $G_{n+1}$ of a triangle formed by three sample points $S_n$, $S_{n+1}$, $S_{n+2}$ and a center of gravity $G_{n+2}$ of a triangle formed by three sample points $S_{n+1}$, $S_{n+2}$, $S_{n+3}$ as interpolation points (interpolated sample points) as shown in FIG. 8C and deletes the sample points $S_{n+1}$ and $S_{n+2}$.

The interpolating operation A is particularly effective in the example shown in FIG. 9 containing a large number of inflection point regions. In the example of FIG. 9, only the line segment $S_5S_6$ is a simply changing region and all other line segments have inflection points.

If it is judged that none of the examined regions contains a specific inflection point (No in step S6), the processing unit 310 serving as the straight line region detecting unit judges whether any of the regions to be examined contains a specific straight line region (step S8).

Specifically, if last three or first three of four consecutive sample points are arranged on a straight line as shown in FIGS. 10A and 10B, respectively, the processing unit 310 serving as the straight line region detecting unit judges that a central line segment of three line segments formed by the four consecutive sample points is a specific straight line region.

If it is judged that a specific straight line region exists in the examined regions (Yes in step S8), the processing unit 310 serving as the interpolating operation unit performs the interpolating operation B (step S9) which is described in detail below.

Figure 10C:
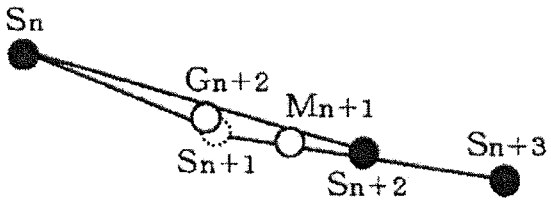
Figure 10D:
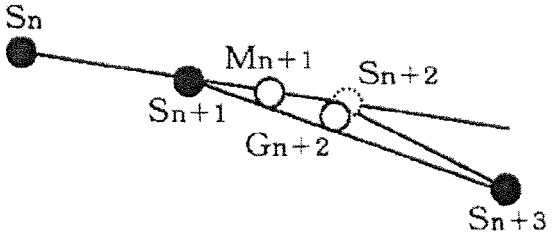

The interpolating operation B applied to Example 4 is such that if last three sample points ($S_{n+1}$, $S_{n+2}$, $S_{n+3}$) of four consecutive sample points ($S_n$, $S_{n+1}$, $S_{n+2}$, $S_{n+3}$) are arranged on a straight line as shown in FIG. 10C, the processing unit 310 deletes the sample point $S_{n+1}$ in the middle of the first three sample points ($S_n$, $S_{n+1}$, $S_{n+2}$) and adds a midpoint $M_{n+1}$ of the intermediate line segment (line segment $S_{n+1}S_{n+2}$) and a center of gravity $G_{n+2}$ of a triangle formed by the first three sample points ($S_n$, $S_{n+1}$, $S_{n+2}$) as interpolation points (interpolated sample points). On the other hand, if the first three sample points ($S_n$, $S_{n+1}$, $S_{n+2}$) are arranged on a straight line as shown in FIG. 10D, the processing unit 310 deletes the sample point $S_{n+2}$ in the middle of the last three sample points ($S_{n+1}$, $S_{n+2}$, $S_{n+3}$) and adds the midpoint $M_{n+1}$ of the intermediate line segment (line segment $S_{n+1}S_{n+2}$) and a center of gravity $G_{n+2}$ of a triangle formed by the last three sample points ($S_{n+1}$, $S_{n+2}$, $S_{n+3}$) as interpolation points (interpolated sample points). This makes it possible to properly perform the interpolating operation on each region which is not a simply changing region or an inflection point region.

If it is judged that none of the examined regions is a specific straight line region (No in step S8), on the other hand, the processing unit 310 serving as the interpolating operation unit performs the interpolating operation C (step S10). As discussed with reference to the foregoing Examples, the interpolating operation C applied to Example 4 is an interpolation process performed on a simply changing region which is not a specific inflection point region or straight line region.

Specifically, as discussed with reference to Examples 1 and 3, with four consecutive sample points ($S_n$, $S_{n+1}$, $S_{n+2}$, $S_{n+3}$) given as shown in FIG. 11A, the processing unit 310 determines an intersection point $C_{n+1}$ of a line extended from a first region line segment $S_nS_{n+1}$ in a direction of $S_{n+1}$ and a line extended from a last region line segment $S_{n+2}S_{n+3}$ in a direction of $S_{n+2}$ and, then, adds a center of gravity $G_{n+1}$ of a triangle $S_{n+1}S_{n+2}C_{n+1}$ as an interpolation point (interpolated sample point) by performing the interpolating operation C. The center of gravity $G_{n+1}$ is a point where three medians of the triangle $S_{n+1}S_{n+2}C_{n+1}$ intersect. Specifically, the center of gravity $G_{n+1}$ is given by the intersection point of a straight line that joins a midpoint $MA_{n+1}$ of a line segment $S_{n+1}C_{n+1}$ to the sample point $S_{n+2}$, a straight line that joins a midpoint $MB_{n+1}$ of a line segment $S_{n+2}C_{n+1}$ to the sample point $S_{n+1}$ and a straight line that joins a midpoint $MC_{n+1}$ of a line segment $S_{n+1}S_{n+2}$ to the aforementioned intersection point $C_{n+1}$.

Figure 12:
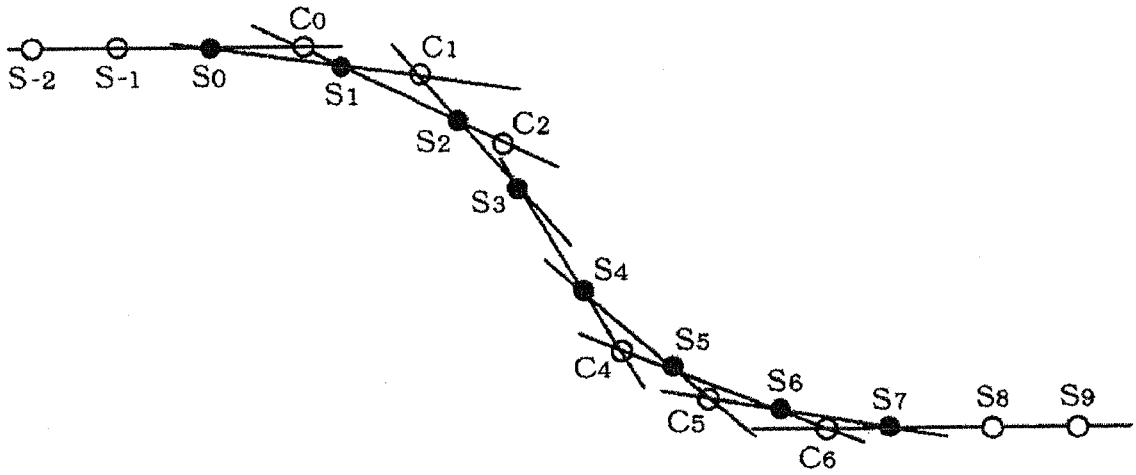
FIG. 12 is an example of a gradation characteristic curve containing a large number of simply changing regions.

FIG. 12 shows an example of a gradation characteristic curve containing a large number of simply changing regions. In FIG. 12, $C_0$-$C_2$ and $C_4$-$C_6$ are examples of the aforementioned intersection point $C_{n+1}$ and only a line segment $S_3S_4$ is a region which is not a simply changing region.

Figure 13:
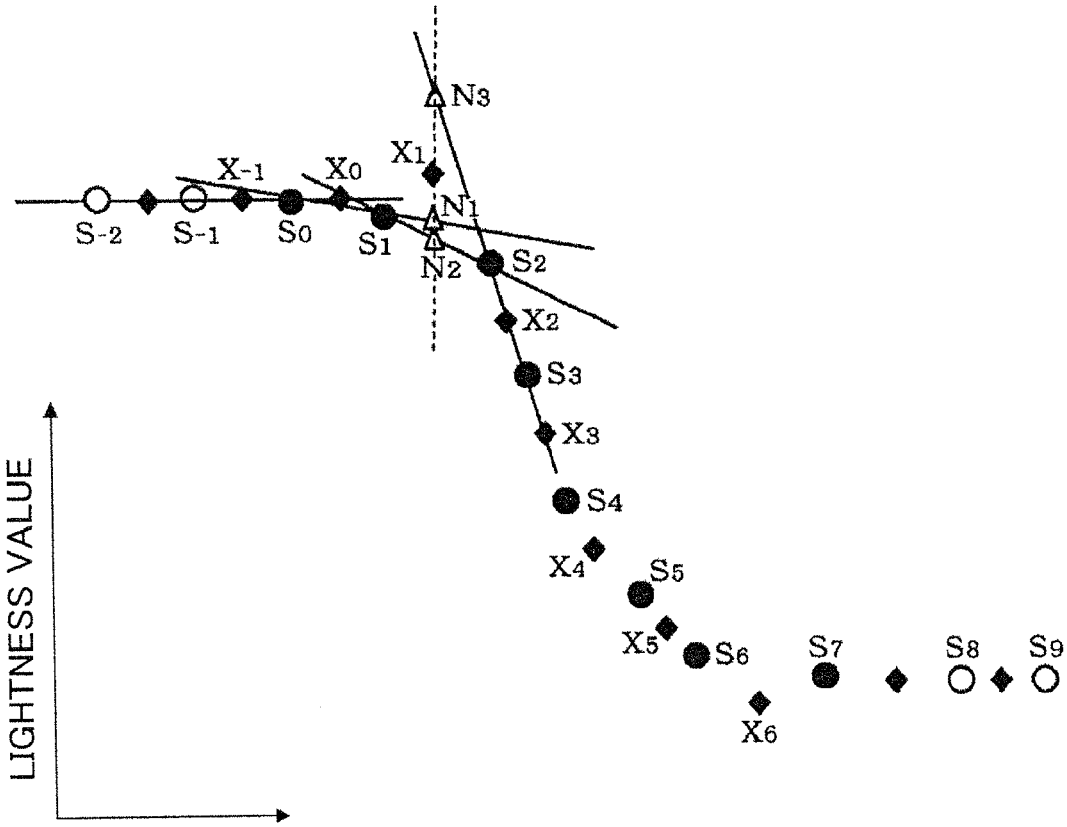
FIG.13 PRIOR ART
FIG. 13 an explanatory diagram showing a problem which occurs during interpolating operation in a conventional gamma correction process, a y-axis representing lightness values.
Figure 14:
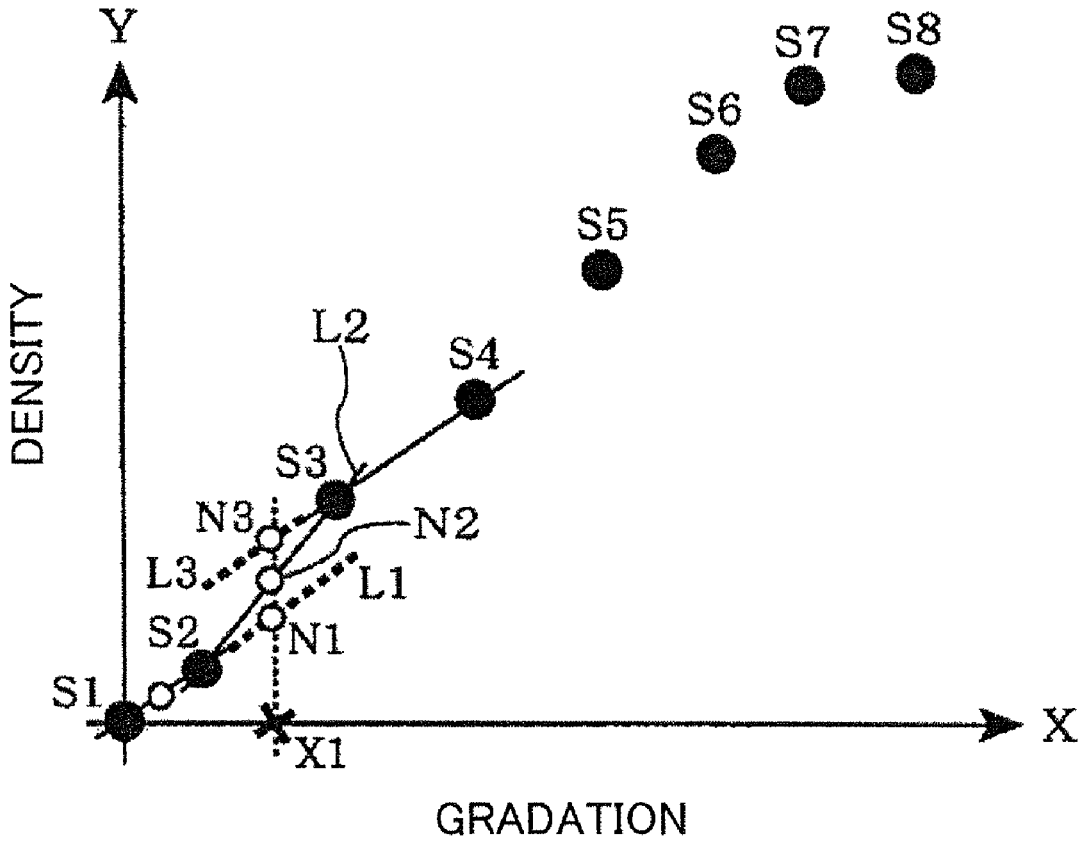
FIG.14 PRIOR ART
FIG. 14 an explanatory diagram showing a method of interpolation used for gamma correction performed by a conventional image forming apparatus.

According to the conventional interpolation method earlier described with reference to FIG. 13, an interpolation point is obtained by calculating a mean value of lightness values of points N1, N2, N3 so that the interpolation point $X_1$ deviates from an actual gradation characteristic of the image forming apparatus 10 as depicted in FIG. 13, making it impossible to obtain a smooth gradation characteristic curve. The interpolating operation C of the present embodiment makes it possible to prevent such inconvenience.

As shown in the foregoing discussion, the interpolating operation unit is controlled to perform the interpolating operation selectively in different ways depending on situations. This approach of the invention makes it possible to accurately obtain the actual gradation characteristic of the image forming apparatus 10 regardless of the presence (or absence) of variations in the gradation characteristic caused by noise, for instance.

Subsequently, the processing unit 310 carries out post processing steps S11 to S14 shown in FIG. 4.

First in a post processing procedure, the processing unit 310 counts the number of the sample points added by the interpolating operations A, B and C as well as the number of the interpolating operations which have been executed (step S11) and, then, judges whether the total number of the sample points has reached a preset number of sample points (step S12).

If the total number of the sample points has not reached the preset number of sample points (No in step S12), the processing unit 310 reexecutes the aforementioned operations of steps S4 to S12. If the total number of the sample points has reached the preset number of sample points (Yes in step S12), on the contrary, the processing unit 310 performs interpolating operation D (step S13).

The interpolating operation D is a process of switching to a method of increasing the number of sample points by a simple interpolating operation after the number of sample points has been increased to a point where errors in sample points added even by a simple linear ratio interpolation can be ignored. The interpolating operation D may further include a process of smoothing a gradation characteristic by a simple moving average operation, for example.

The interpolating operation D may be used only for alleviating work load in the core processing or for improving processing speed therein. When not executing the interpolating operation D, the processing unit 310 performs the interpolating operations A, B and C, where necessary, until the total number of the sample points reaches the preset number of sample points.

Next, the processing unit 310 performs end point processing operation B for removing the auxiliary data on the imaginary sample points added by the earlier-described end point processing operation A of step S3 as well as data on any points between the added imaginary sample points.

By performing the above-described operations of steps S1 through S14, the processing unit 310 serving as the characteristic acquisition unit can acquire a gradation characteristic closely approximating the actual gradation characteristic of the image forming apparatus 10.

Finally, the processing unit 310 corrects a preset input-output characteristic, that is, the gamma characteristic initially set in the image forming apparatus 10 (step S15).

The image forming apparatus 10 is configured to control the amount of toner supply or the like according to the corrected gamma characteristic thus obtained in order to adjust the density or lightness of each output image. Accordingly, it is possible to ensure that the input-output characteristic of the image forming apparatus 10 closely approximates an ideal gamma characteristic by correcting and updating an inherent gamma characteristic of the image forming apparatus 10 based on the gamma characteristic actually obtained by the above-described procedure of the preferred embodiment of the invention.

To be more specific, the image forming apparatus 10 of the embodiment makes it possible to control the amount of toner supply or the like by manually or automatically correcting the inherent gamma characteristic or updating a correction table prepared in advance, for example, referring to the gamma characteristic representing all of the multi-level gradations (e.g., 256 tone levels) obtained by the operations of steps S1 through S14 of the flowchart.

An adjustment unit for adjusting the amount of toner supply can be realized as a unit which varies the amount of light exposure (power or exposure time) used for forming a latent image or exposure area (expressed in terms of the number of exposed dots), for example.

As thus far described, according to the image forming apparatus 10 (and the gamma correction program) of the present embodiment, the image forming block 100 first forms calibration patch images, the sensor unit 330 measures the lightness of each of the patch images and, then, the processing unit 310 selects a relatively small number of sample points and arranges measured values (tone levels) of the sample points on a lightness-gradation coordinate system. Then, the processing unit 310 efficiently acquires a gradation characteristic closely approximating the actual gradation characteristic of the image forming apparatus 10 by carrying out different kinds of interpolating operations which are selected as appropriate according to patterns of line segments successively formed by the consecutive sample points.

This arrangement of the foregoing embodiment makes it possible to efficiently obtain a gradation characteristic accurately approximating the actual gradation characteristic of the image forming apparatus 10. Also, the arrangement of the embodiment can be used for the gamma correction process in an effective fashion.

Furthermore, the arrangement of the embodiment enables the image forming apparatus 10 to continuously maintain an ideal gamma characteristic by calibrating or correcting the gamma characteristic of the image forming apparatus 10 at regular time intervals or whenever necessary. Moreover, such calibration and correction make it possible to properly control the amount of toner supply when the image forming apparatus 10 becomes likely to produce errors due to changes occurring over time or changes in ambient conditions of operation, for instance.

While the image forming apparatus 10 and the gamma correction program according to the preferred embodiment of the invention has thus far been described, the invention is not limited to the foregoing embodiment but may be altered or modified in various ways within the scope of the present invention which is defined by the appended claims.

Specifically, while the invention has been described with reference to the preferred embodiment in which the image forming apparatus 10 is a printer, the invention is applicable not only to printers but also to other kinds of image forming apparatuses configured to perform image forming operation. The image forming apparatuses to which the invention can be applied include, in addition to the printer, various appliances and devices, such as a facsimile machine, a copying machine and a hybrid apparatus thereof.

The gamma correction program is stored in a storage medium which is readable by an appropriate computer, such as a read-only memory (ROM), a hard disk, a flexible disk, a memory card or a magneto-optic (MO) disk. The gamma correction program read from the storage medium is installed in an electronic apparatus (image forming apparatus) and gives instructions to individual constituent elements of the apparatus to cause these elements to carry out specific processing steps and functions.

In summary, according to one embodiment of the invention, an image forming apparatus is configured to control the density of an output image based on an inherent gamma characteristic of the image forming apparatus. The image forming apparatus includes a patch image forming unit that forms a plurality of patch images having multiple gradation values on a specific medium, a measuring unit that measures the density or lightness of each of the patch images formed on the medium, a sample point arrangement unit that arranges sample points representative of measured density or lightness values in a descending or ascending order of the gradation values, an inflection point region detecting unit that detects any specific inflection point region from among regions defined between the consecutively arranged sample points, a straight line region detecting unit that detects any specific straight line region from among the regions defined between the consecutively arranged sample points, an interpolating operation unit that performs interpolating operation by adding and/or deleting a specific sample point depending on whether (i) an inflection point region is detected, (ii) a straight line region is detected, or (iii) neither an inflection point region nor a straight line region is detected, a characteristic acquisition unit that acquires a gradation characteristic by the interpolating operation, and a characteristic correction unit that corrects the gamma characteristic based on the acquired gradation characteristic.

In another embodiment of the invention, as previously described with reference to Example 1, the interpolating operation unit performs the interpolating operation in such a way that (i) if a specific inflection point region is found among regions defined by four consecutively arranged sample points $S_n$ to $S_{n+3}$, the interpolating operation unit adds a midpoint of a line segment $S_{n+1}S_{n+2}$ as a new sample point and deletes the sample points $S_{n+1}$ and $S_{n+2}$; (ii) if a specific straight line region is found among the regions defined by the four consecutively arranged sample points $S_n$ to $S_{n+3}$, the interpolating operation unit adds the midpoint of the line segment $S_{n+1}S_{n+2}$ as a new sample point; and (iii) if neither an inflection point region nor a straight line region is found among the regions defined by the four consecutively arranged sample points $S_n$ to $S_{n+3}$, the interpolating operation unit adds a center of gravity of a triangle formed by the sample points $S_{n+1}$ and $S_{n+2}$ and an intersection point of a straight line containing a line segment $S_nS_{n+1}$ and a straight line containing a line segment $S_{n+2}S_{n+3}$ as a new sample point.

In another embodiment of the invention, as previously described with reference to Example 2, the interpolating operation unit performs the interpolating operation in such a way that (i) if a specific inflection point region is found among regions defined by four consecutively arranged sample points $S_n$ to $S_{n+3}$, the interpolating operation unit adds a midpoint of a line segment $S_{n+1}S_{n+2}$ as a new sample point and deletes the sample points $S_{n+1}$ and $S_{n+2}$; (ii) if a specific straight line region is found among the regions defined by the four consecutively arranged sample points $S_n$ to $S_{n+3}$, the interpolating operation unit adds the midpoint of the line segment $S_{n+1}S_{n+2}$ as a new sample point; and (iii) if neither an inflection point region nor a straight line region is found among the regions defined by the four consecutively arranged sample points $S_n$ to $S_{n+3}$, the interpolating operation unit adds an incenter of a triangle formed by the sample points $S_{n+1}$ and $S_{n+2}$ and an intersection point of a straight line containing a line segment $S_nS_{n+1}$ and a straight line containing a line segment $S_{n+2}S_{n+3}$ as a new sample point.

In another embodiment of the invention, as previously described with reference to Example 3, the interpolating operation unit performs the interpolating operation in such a way that (i) if a specific inflection point region is found among regions defined by four consecutively arranged sample points $S_n$ to $S_{n+3}$, the interpolating operation unit adds a center of gravity of a triangle formed by the sample points $S_n$, $S_{n+1}$ and $S_{n+2}$ and a center of gravity of a triangle formed by the sample points $S_{n+1}$, $S_{n+2}$ and $S_{n+3}$ as new sample points and deletes the sample points $S_{n+1}$ and $S_{n+2}$; (ii) if a specific straight line region is found among the regions defined by the four consecutively arranged sample points $S_n$ to $S_{n+3}$, the interpolating operation unit adds a midpoint of a line segment $S_{n+1}S_{n+2}$ as a new sample point; and (iii) if neither an inflection point region nor a straight line region is found among the regions defined by the four consecutively arranged sample points $S_n$ to $S_{n+3}$, the interpolating operation unit adds a center of gravity of a triangle formed by the sample points $S_{n+1}$ and $S_{n+2}$ and an intersection point of a straight line containing a line segment $S_nS_{n+1}$ and a straight line containing a line segment $S_{n+2}S_{n+3}$ as a new sample point.

In another embodiment of the invention, as previously described with reference to Example 4, the interpolating operation unit performs the interpolating operation in such a way that (i) if a specific inflection point region is found among regions defined by four consecutively arranged sample points $S_n$ to $S_{n+3}$, the interpolating operation unit adds a center of gravity of a triangle formed by the sample points $S_n$, $S_{n+1}$ and $S_{n+2}$ and a center of gravity of a triangle formed by the sample points $S_{n+1}$, $S_{n+2}$ and $S_{n+3}$ as new sample points and deletes the sample points $S_{n+1}$ and $S_{n+2}$; (iia) if a straight line region defined by the sample points $S_n$, $S_{n+1}$ and $S_{n+2}$ arranged on a straight line is found, the interpolating operation unit deletes the sample point $S_{n+2}$ and adds a midpoint of a line segment $S_{n+1}S_{n+2}$ and a center of gravity of a triangle formed by the sample points $S_{n+1}$ $S_{n+2}$ and $S_{n+3}$ as new sample points; (iib) if a straight line region defined by the sample points $S_{n+1}$ $S_{n+2}$ and $S_{n+3}$ arranged on a straight line is found, the interpolating operation unit deletes the sample point $S_{n+1}$ and adds the midpoint of the line segment $S_{n+1}S_{n+2}$ and a center of gravity of a triangle formed by the sample points $S_n$, $S_{n+1}$ and $S_{n+2}$ as new sample points; and (iii) if neither an inflection point region nor a straight line region is found among the regions defined by the four consecutively arranged sample points $S_n$ to $S_{n+3}$, the interpolating operation unit adds a center of gravity of a triangle formed by the sample points $S_{n+1}$ and $S_{n+2}$ and an intersection point of a straight line containing a line segment $S_nS_{n+1}$ and a straight line containing a line segment $S_{n+2}S_{n+3}$ as a new sample point.

In another embodiment of the invention, the inflection point region detecting unit judges that a specific inflection point region exists among regions defined by four consecutively arranged sample points $S_n$ to $S_{n+3}$ if a turning direction of a line segment $S_{n+1}S_{n+2}$ from a line segment $S_nS_{n+1}$ and a turning direction of a line segment $S_{n+2}S_{n+3}$ from the line segment $S_{n+1}S_{n+2}$ differ from each other.

Alternatively, in another embodiment of the invention, with four consecutively arranged sample points $S_n$ to $S_{n+3}$ given, the inflection point region detecting unit determines a difference between the gradients of a line segment $S_nS_{n+1}$ and a line segment $S_{n+1}S_{n+2}$ and a difference between the gradients of the line segment $S_{n+1}S_{n+2}$ and a line segment $S_{n+2}S_{n+3}$, and judges that a specific inflection point region exists among regions defined by the four consecutively arranged sample points $S_n$ to $S_{n+3}$ if the two gradient differences have the same plus/minus sign.

In another embodiment of the invention, with four consecutively arranged sample points $S_n$ to $S_{n+3}$ given, the straight line region detecting unit judges that a specific straight line region exists among regions defined by the four consecutively arranged sample points $S_n$ to $S_{n+3}$ if one of combinations of the consecutively arranged sample points $S_n$, $S_{n+1}$ and $S_{n+2}$ and of the consecutively arranged sample points $S_{n+1}$, $S_{n+2}$ and $S_{n+3}$ forms a straight line.

The image forming apparatus of the above embodiments of the invention thus configured first forms a specific pattern of patch images, measures the lightness of each of the patch images, extracts a relatively small number of sample points having different input gradation values and arranges the sample points on a specific coordinate system. Then, the image forming apparatus adds new sample points between the extracted sample points by performing the interpolating operation to acquire the gradation characteristic of the image forming apparatus covering all gradation values.

This approach of the above embodiments of the invention makes it possible to acquire the actual density gradation characteristic of the image forming apparatus with high accuracy and properly perform gamma correction and calibration operation.

In particular, the image forming apparatus of the above embodiments of the present invention focuses on four consecutive sample points arranged in the order of gradation values and corrects the gamma characteristic by normally adding a center of gravity of a triangle formed according to a specific algorithm by performing the interpolating operation. In a case where regions defined by the four consecutive sample points contain a particular kind of region, such as an inflection point region or a straight line region, the image forming apparatus corrects the gamma characteristic by performing the interpolating operation in a different way.

Specifically, the image forming apparatus normally adds the center of gravity of the triangle formed by the sample points $S_{n+1}$ and $S_{n+2}$ and the intersection point of the line segment $S_nS_{n+1}$ and the line segment $S_{n+2}S_{n+3}$ as a new sample point. However, if the regions defined by the four consecutive sample points contain a specific inflection point region, that is, if the turning direction of the line segment $S_{n+1}S_{n+2}$ from the line segment $S_nS_{n+1}$ and the turning direction of the line segment $S_{n+2}S_{n+3}$ from the line segment $S_{n+1}S_{n+2}$ differ from each other, the image forming apparatus adds the midpoint of the line segment $S_{n+1}S_{n+2}$ as a new sample point and deletes the sample points $S_{n+1}$ and $S_{n+2}$.

Similarly, if the regions defined by the four consecutive sample points contain a specific straight line region, that is, if one of combinations of the consecutively arranged sample points $S_n$, $S_{n+1}$ and $S_{n+2}$ and of the consecutively arranged sample points $S_{n+1}$, $S_{n+2}$ and $S_{n+3}$ forms a straight line, the image forming apparatus adds the midpoint of the line segment $S_{n+1}S_{n+2}$ as a new sample point.

This approach of the above embodiment of the invention makes it possible to acquire the original gradation characteristic of the image forming apparatus with high accuracy and properly perform gamma correction without the influence of particular variations in the gradation characteristic caused by noise, for instance.

Furthermore, it is possible to make a correction for time-dependent changes occurring in the gradation characteristic of the image forming apparatus and maintain a balance of density gradations as defined by an initially set gamma characteristic. This would be efficiently achieved by carrying out the above-described calibration operation of the above embodiment of the invention at regular intervals.

In still another embodiment of the invention, provided that a sample point $S_n$ has a minimum gradation value among a fixed number of measured sample points, the interpolating operation unit adds imaginary sample points $S_{n-1}$ and $S_{n-2}$ having the same density value as the sample point $S_n$ but progressively smaller gradation values than the sample point $S_n$ and performs the interpolating operation on regions of $S_{n-2}$ to $S_{n+1}$ and $S_{n-1}$ to $S_{n+2}$.

In yet another embodiment of the invention, provided that a sample point $S_n$ has a maximum gradation value among a fixed number of measured sample points, the interpolating operation unit adds imaginary sample points $S_{n+1}$ and $S_{n+2}$ having the same density value as the sample point $S_n$ but progressively larger gradation values than the sample point $S_n$ and performs the interpolating operation on regions of $S_{n-2}$ to $S_{n+1}$ and $S_{n-1}$ to $S_{n+2}$.

The image forming apparatus of the above embodiments of the invention thus configured additionally arranges imaginary sample points in the vicinity of each end point of the initially arranged sample points and performs the interpolating operation on regions in the vicinity of each end point. This approach of the above embodiments of the invention makes it possible to perform the interpolating operation on all of the sample points without the need to perform a special interpolating operation on the end points. It is therefore possible to easily acquire the entirety of the gradation characteristic of the image forming apparatus and improve the efficiency of the gamma correction and calibration operation.

According to the another embodiment of the invention, a storage medium stores a gamma correction program used for output density control of an image forming apparatus which outputs image data based on an inherent gamma characteristic of the image forming apparatus. The gamma correction program stored in the storage medium of the embodiment of the invention causes a computer which constitutes the image forming apparatus to function as a patch image forming unit that forms a plurality of patch images having multiple gradation values on a specific medium, a measuring unit that measures the density or lightness of each of the patch images formed on the medium, a sample point arrangement unit that arranges sample points representative of measured density or lightness values in a descending or ascending order of the gradation values, an inflection point region detecting unit that detects any specific inflection point region from among regions defined between the consecutively arranged sample points, a straight line region detecting unit that detects any specific straight line region from among the regions defined between the consecutively arranged sample points, an interpolating operation unit that performs interpolating operation by adding and/or deleting a specific sample point where necessary, a characteristic acquisition unit that acquires a gradation characteristic by the interpolating operation, and a characteristic correction unit that corrects the gamma characteristic based on the acquired gradation characteristic. The interpolating operation unit adds and/or deletes the specific sample point depending on whether (i) an inflection point region is detected, (ii) a straight line region is detected, or (iii) neither an inflection point region nor a straight line region is detected.

The gamma correction program stored in the storage medium of the embodiment of the invention can control the aforementioned interpolating operation unit to perform the same functions as performed by the interpolating operation unit in the previously discussed Examples 1 to 4.

The embodiment of the present invention can provide a program as discussed above. This program can be configured as a gamma correction program offering versatile applicability and superior extendibility that can be installed in a wide variety of image forming apparatuses to realize a printer, a facsimile machine or a copying machine, for example.

Yet another embodiment of the invention also provides a method of performing gamma correction for output density control of an image forming apparatus which outputs image data based on an inherent gamma characteristic of the image forming apparatus. This gamma correction method of the embodiment of the invention includes the steps of forming a plurality of patch images having multiple gradation values on a specific medium, measuring the density or lightness of each of the patch images formed on the medium, arranging sample points representative of measured density or lightness values in a descending or ascending order of the gradation values, detecting any specific inflection point region from among regions defined between the consecutively arranged sample points, detecting any specific straight line region from among the regions defined between the consecutively arranged sample points, performing interpolating operation by adding and/or deleting a specific sample point depending on whether (i) an inflection point region is detected, (ii) a straight line region is detected, or (iii) neither an inflection point region nor a straight line region is detected, acquiring a gradation characteristic by the interpolating operation, and correcting the gamma characteristic based on the acquired gradation characteristic.

According to the embodiment of the invention, the aforementioned step of performing the interpolating operation can be made to perform the same functions as performed by the interpolating operation unit in the previously discussed Examples 1 to 4.

As will be appreciated from the foregoing discussion, the image forming apparatuses of the present invention can acquire the actual density gradation characteristic (gamma characteristic) of the image forming apparatus with ease and high accuracy and properly perform the gamma correction and calibration operation regardless of the presence (or absence) of particular variations in the gradation characteristic caused by noise or end points, for instance.

The present invention can be conveniently applied to various image forming apparatuses having a gamma correction function.

This application is based on FOUR (4) Japanese Patent Application Serial Nos. 2007-132963, 2007-132964, 2007-132965 and 2007-132966 filed with Japan Patent Office all on May 18, 2007, the contents of which are hereby incorporated by reference.

Although the present invention has been fully described by way of example with reference to the accompanying drawings, it is to be understood that various changes and modifications will be apparent to those skilled in the art. Therefore, unless such changes and modifications depart from the scope of the present invention hereinafter defined, the changes and modifications should be construed as being included therein.

What is claimed is:

1. An image forming apparatus configured to control the density of an output image based on an inherent gamma characteristic of the image forming apparatus which comprises:

a patch image forming unit that forms a plurality of patch images having multiple gradation values on a specific medium;

a measuring unit that measures the density or lightness of each of the patch images formed on the medium;

a sample point arrangement unit that arranges sample points representative of measured density or lightness values in a descending or ascending order of the gradation values;

an inflection point region detecting unit that detects any specific inflection point region from among regions defined between the consecutively arranged sample points;

a straight line region detecting unit that detects any specific straight line region from among the regions defined between the consecutively arranged sample points;

an interpolating operation unit that performs interpolating operation by adding and/or deleting a specific sample point depending on whether (i) an inflection point region is detected among regions defined by four consecutively arranged sample points $S_n$ to $S_{n+3}$, (ii) a straight line region is detected among regions defined by four consecutively arranged sample points $S_n$ to $S_{n+3}$, or (iii) neither an inflection point region nor a straight line region is detected among regions defined by four consecutively arranged sample points $S_n$ to $S_{n+3}$;

(i) in case the above condition (i) is met, (ia) the interpolating operation unit adds a midpoint of a line segment $S_{n+1}S_{n+2}$ as a new sample point and deletes the sample points $S_{n+1}$ and $S_{n+2}$; or (ib) the interpolating operation unit adds a center of gravity of a triangle formed by the sample points $S_n$, $S_{n+1}$, and $S_{n+2}$ and a center of gravity of a triangle formed by the sample points $S_{n+1}$, $S_{n+2}$ and $S_{n+3}$ as new sample points and deletes the sample points $S_{n+1}$ and $S_{n+2}$;

(ii) in case the above condition (ii) is met, the interpolating operation unit adds the midpoint of the line segment $S_{n+1}S_{n+2}$ as a new sample point;

(iii) in case that the above condition (iii) is met, the interpolating operation unit adds a center of gravity of a triangle formed by the sample points $S_{n+1}$ and $S_{n+2}$ and an intersection point of a straight line containing a line segment $S_nS_{n+1}$ and a straight line containing a line segment $S_{+2}S_{n+3}$ as a new sample point, or the interpolating operation unit adds an incenter of a triangle formed by the sample points $S_{n+1}$ and $S_{n+2}$ and an intersection point of a straight line containing a line segment $S_nS_{n+1}$ and a straight line containing a line segment $S_{n+2}S_{n+3}$ as a new sample point;

a characteristic acquisition unit that acquires a gradation characteristic by the interpolating operation; and a characteristic correction unit that corrects the gamma characteristic based on the acquired gradation characteristic.

2. The image forming apparatus according to claim 1, wherein the interpolating operation unit performs the interpolating operation in such a way that:

(iia) if a straight line region defined by the sample points $S_n$, $S_{n+1}$ and $S_{n+2}$arranged on a straight line is found, the interpolating operation unit deletes the sample point $S_{n+2}$ and adds a midpoint of a line segment $S_{n+1}S_{n+2}$ and a center of gravity of a triangle formed by the sample points $S_{n+1}$, $S_{n+2}$ and $S_{n+3}$ as new sample points; and (iib) if a straight line region defined by the sample points $S_{n+1}$, $S_{n+2}$ and $S_{n+3}$arranged on a straight line is found, the interpolating operation unit deletes the sample point $S_{n+1}$ and adds the midpoint of the line segment $S_{n+1}S_{n+2}$ and a center of gravity of a triangle formed by the sample points $S_n$, $S_{n+2}$ and $S_{n+2}$ as new sample points.

3. The image forming apparatus according to claim 1, wherein the inflection point region detecting unit judges that a specific inflection point region exists among regions defined by four consecutively arranged sample points $S_n$ to $S_{n+3}$ if a turning direction of a line segment $S_{n+1}S_{n+2}$ from a line segment $S_nS_{n+1}$ and a turning direction of a line segment $S_{n+2}S_{n+3}$ from the line segment $S_{n+1}S_{n+2}$ differ from each other.

4. The image forming apparatus according to claim 1, wherein, with four consecutively arranged sample points $S_n$ to $S_{n+3}$ given, the inflection point region detecting unit determines a difference between the gradients of a line segment $S_nS_{n+1}$ and a line segment $S_{n+1}S_{n+2}$ and a difference between the gradients of the line segment $S_{n+1}S_{n+2}$ and a line segment $S_{n+2}S_{n+3}$, and judges that a specific inflection point region exists among regions defined by the four consecutively arranged sample points $S_n$ to $S_{n+3}$ if the two gradient differences have the same plus/minus sign.

5. The image forming apparatus according to claim 1, wherein, with four consecutively arranged sample points $S_n$ to $S_{n+3}$ given, the straight line region detecting unit judges that a specific straight line region exists among regions defined by the four consecutively arranged sample points $S_n$ to $S_{n+3}$ if one of combinations of the consecutively arranged sample points $S_n$, $S_{n+1}$ and $S_{n+2}$ and of the consecutively arranged sample points $S_{n+1}$, $S_{n+2}$ and $S_{n+3}$ forms a straight line.

6. The image forming apparatus according to claim 1, wherein, provided that a sample point $S_n$ has a minimum gradation value among a fixed number of measured sample points, the interpolating operation unit adds imaginary sample points $Sn_{-1}$ and $S_{n-2}$ having the same density value as the sample point $S_n$ but progressively smaller gradation values than the sample point $S_n$ and performs the interpolating operation on regions of $S_{n-2}$ to $S_{n+1}$ and $S_{n-1}$ to $S_{n+2}$.

7. The image forming apparatus according to claim 1, wherein, provided that a sample point $S_n$ has a maximum gradation value among a fixed number of measured sample points, the interpolating operation unit adds imaginary sample points $S_{n+1}$ and $S_{n+2}$ having the same density value as the sample point $S_n$ but progressively larger gradation values than the sample point $S_n$ and performs the interpolating operation on regions of $S_{n-2}$ to $S_{n+1}$ and $S_{n-1}$ to $S_{n+2}$.

8. A non-transitory storage medium storing a gamma correction program used for output density control of an image forming apparatus which outputs image data based on an inherent gamma characteristic of the image forming apparatus, wherein the gamma correction program causes a computer which constitutes the image forming apparatus to function as:

a patch image forming unit that forms a plurality of patch images having multiple gradation values on a specific medium;

a measuring unit that measures the density or lightness of each of the patch images formed on the medium;

a sample point arrangement unit that arranges sample points representative of measured density or lightness values in a descending or ascending order of the gradation values;

an inflection point region detecting unit that detects any specific inflection point region from among regions defined between the consecutively arranged sample points;

a straight line region detecting unit that detects any specific straight line region from among the regions defined between the consecutively arranged sample points;

an interpolating operation unit that performs interpolating operation by adding and/or deleting a specific sample point depending on whether (i) an inflection point region is detected among regions defined by four consecutively arranged sample points $S_n$ to $S_{n+3}$, (ii) a straight line region is detected among regions defined by four consecutively arranged sample points $S_n$ to $S_{n+3}$, or (iii) neither an inflection point region nor a straight line region is detected among regions defined by four consecutively arranged sample points $S_n$ to $S_{n+3}$;

(i) in case the above condition (i) is met, (ia) the interpolating operation unit adds a midpoint of a line segment $S_{n+1}S_{n+2}$ as a new sample point and deletes the sample points $S_{n+1}$ and $S_{n+2}$; or (ib) the interpolating operation unit adds a center of gravity of a triangle formed by the sample points $S_n$, $S_{n+1}$ and $S_{n+2}$ and a center of gravity of a triangle formed by the sample points $S_{n+1}$, $S_{n+2}$ and $S_{n+3}$ as new sample points and deletes the sample points $S_{n+1}$ and $S_{n+2}$;

(ii) in case the above condition (ii) is met, the interpolating operation unit adds the midpoint of the line segment $S_{n+1}S_{n+2}$ as a new sample point;

(iii) in case that the above condition (iii) is met, the interpolating operation unit adds a center of gravity of a triangle formed by the sample points $S_{n+1}$ $S_{n+2}$ and an intersection point of a straight line containing a line segment $S_nS_{n+1}$ and a straight line containing a line segment $S_{n+2}S_{n+3}$ as a new sample point, or the interpolating operation unit adds an incenter of a triangle formed by the sample points $S_{n+1}$ and $S_{n+2}$ and an intersection point of a straight line containing a line segment $S_nS_{n+1}$ and a straight line containing a line segment $S_{n+2}S_{n+3}$ as a new sample point;

a characteristic acquisition unit that acquires a gradation characteristic by the interpolating operation; and a characteristic correction unit that corrects the gamma characteristic based on the acquired gradation characteristic.

9. The storage medium storing the gamma correction program according to claim 8, wherein the gamma correction program causes the interpolating operation unit to perform the interpolating operation in such a way that:

(iia) if a straight line region defined by the sample points $S_n$, $S_{n+1}$ and $S_{n+2}$ arranged on a straight line is found, the interpolating operation unit deletes the sample point $S_{n+2}$ and adds a midpoint of a line segment $S_{n+1}S_{n+2}$ and a center of gravity of a triangle formed by the sample points $S_{n+1}$, $S_{n+2}$ and $S_{n+3}$ as new sample points; and (iib) if a straight line region defined by the sample points $S_{n+1}$, $S_{n+2}$ and $S_{n+3}$ arranged on a straight line is found, the interpolating operation unit deletes the sample point $S_{n+1}$ and adds the midpoint of the line segment $S_{n+1}$ $S_{n+2}$ and a center of gravity of a triangle formed by the sample points $S_n$, $S_{n+1}$ and $S_{n+2}$ as new sample points.

10. A method of performing gamma correction for output density control of an image forming apparatus which outputs image data based on an inherent gamma characteristic of the image forming apparatus, the method comprising the steps of:

forming a plurality of patch images having multiple gradation values on a specific medium;

measuring the density or lightness of each of the patch images formed on the medium;

arranging sample points representative of measured density or lightness values in a descending or ascending order of the gradation values;

detecting any specific inflection point region from among regions defined between the consecutively arranged sample points;

detecting any specific straight line region from among the regions defined between the consecutively arranged sample points;

performing interpolating operation by adding and/or deleting a specific sample point depending on whether (i) an inflection point region is detected among regions defined by four consecutively arranged sample points $S_n$ to $S_{n+3}$, (ii) a straight line region is detected among regions defined by four consecutively arranged sample points $S_n$ to $Sn_{+3}$, or (iii) neither an inflection point region nor a straight line region is detected among regions defined by four consecutively arranged sample points $S_n$ to $S_{n+3}$;

(i) in case the above condition (i) is met, (ia) adding a midpoint of a line segment $S_{n+1}S_{n+2}$ as a new sample point and deletes the sample points $S_{n+1}$ and $S_{n+2}$; or (ib) adding a center of gravity of a triangle formed by the sample points $S_n$, $S_{n+1}$ and $S_{n+2}$ and a center of gravity of a triangle formed by the sample points $S_{n+1}$, $S_{n+2}$ and $S_{n+3}$ as new sample points and deletes the sample points $S_{n+1}$ and $S_{n+2}$;

(ii) in case the above condition (ii) is met, adding the midpoint of the line segment $S_{n+1}S_{n+2}$ as a new sample point;

(iii) in case that the above condition (iii) is met, adding a center of gravity of a triangle formed by the sample points $S_{n+1}$ and $S_{n+2}$ and an intersection point of a straight line containing a line segment $S_nS_{n+1}$ and a straight line containing a line segment $S_{n+2}S_{n+3}$ as a new sample point, or adding an incenter of a triangle formed by the sample points $S_{n+1}$ and $S_{n+2}$ and an intersection point of a straight line containing a line segment $S_nS_{n+1}$ and a straight line containing a line segment $S_{n+2}S_{n+3}$ as a new sample point;

acquiring a gradation characteristic by the interpolating operation; and correcting the gamma characteristic based on the acquired gradation characteristic.

11. The method of performing the gamma correction according to claim 10, wherein the step of performing the interpolating operation is such that:

(iia) if a straight line region defined by the sample points $S_n$, $S_{n+1}$ and $S_{n+2}$ arranged on a straight line is found, the interpolating operation deletes the sample point $S_{n+2}$ and adds a midpoint of a line segment $S_{n+1}S_{n+2}$ and a center of gravity of a triangle formed by the sample points $S_{n+1}$, $S_{n+2}$ and $S_{n+3}$ as new sample points; and (iib) if a straight line region defined by the sample points $S_{n+1}$, $S_{n+2}$ and $S_{n+3}$ arranged on a straight line is found, the interpolating operation deletes the sample point $S_{n+1}$ and adds the midpoint of the line segment $S_{n+1}S_{n+2}$ and a center of gravity of a triangle formed by the sample points $S_n$, $S_{n+1}$ and $S_{n+2}$ as new sample points.

* * * * *